US006661977B1

(12) United States Patent
Kubota

(10) Patent No.: US 6,661,977 B1
(45) Date of Patent: Dec. 9, 2003

(54) ELECTROPHOTOGRAPHIC IMAGE FORMING APPARATUS AND PROCESS CARTRIDGE

(75) Inventor: Takeshi Kubota, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,149

(22) Filed: Jul. 30, 2002

(30) Foreign Application Priority Data

Jun. 4, 2002 (JP) ..... 2002-162324

(51) Int. Cl.[7] ..... G03G 15/00; G03G 21/00; G03G 21/18

(52) U.S. Cl. ..... 399/12; 399/114

(58) Field of Search ..... 399/12, 111, 112, 399/113, 114

(56) References Cited

U.S. PATENT DOCUMENTS 5,559,581 A 9/1996 Sugiura et al. ..... 355/200
5,561,496 A 10/1996 Sugiura et al. ..... 355/200
5,634,178 A 5/1997 Sugiura et al. ..... 355/200
5,983,054 A * 11/1999 Kameyama ..... 399/125
6,084,622 A 7/2000 Sugiura et al. ..... 347/170
2002/0110385 A1 * 8/2002 Terada et al. ..... 399/111

FOREIGN PATENT DOCUMENTS

JP 9-185254 A * 7/1997

* cited by examiner

*Primary Examiner*—Joan Pendegrass
(74) *Attorney, Agent, or Firm*—Fitzpatrick, Cella, Harper & Scinto

(57) ABSTRACT

A wrong insertion preventing mechanism of simple construction is realized without requiring any sensor for discriminating the incompatibility of a process cartridge to the main body of an image forming apparatus. When an improper cartridge which does not match in function with the main body of the apparatus is wrongly inserted, a cam portion for opening and closing a shutter comes into engagement with a wrong insertion preventing engagement portion in the opening portion of the main body of the apparatus and the shutter is opened, whereby the wrong insertion of the cartridge is blocked. In the case of a proper cartridge, it is inserted without the shutter being opened in the opening portion of the main body of the apparatus, and with the operation of closing an openable and closable member, the cartridge is inserted into the inner part of the main body of the apparatus together with a moving guide and the shutter is opened at a proper position.

15 Claims, 15 Drawing Sheets

ELECTROPHOTOGRAPHIC IMAGE FORMING APPARATUS AND PROCESS CARTRIDGE

BACKGROUND OF THE INVENTION

1. Field of the Invention

This invention relates to an electrophotographic image forming apparatus and a process cartridge.

Here, the process cartridge refers to charging means, developing means or cleaning means as process means and an electrophotographic photosensitive member integrally made into a cartridge which is made detachably mountable to the main body of an electrophotographic image forming apparatus. Or it refers to at least one of charging means, developing means and cleaning means as process means and an electrophotographic photosensitive member integrally made into a cartridge which is made detachably mountable to the main body of an electrophotographic image forming apparatus. Further, it refers to at least process means, developing means and an electrophotographic photosensitive member integrally made into a cartridge which is made detachably mountable to the main body of an electrophotographic image forming apparatus.

Also, the electrophotographic image forming apparatus uses the electrophotographic image forming process to form an image on a recording medium. For example, it covers an electrophotographic copying machine, an electrophotographic printer (such as an LED printer or a laser beam printer), an electrophotographic facsimile apparatus and an electrophotographic word processor.

2. Description of Related Art

In an electrophotographic image forming apparatus, there has heretofore been adopted a process cartridge system in which an electrophotographic photosensitive member and process means for acting on the electrophotographic photosensitive member are integrally made into a cartridge which is made detachably mountable to the main body of the image forming apparatus. According to this process cartridge system, a user himself can effect the maintenance of the apparatus without resort to a serviceman and therefore, operability could be markedly improved. So, this process cartridge system is widely used in electrophotographic image forming apparatuses.

An electrophotographic image forming apparatus of such a cartridge type is of such a structure in which only a cartridge matching in function with the main body of the image forming apparatus can be mounted.

That is, if an attempt is made to mount a cartridge not matching in function with the main body of an image forming apparatus, the design of the cartridge side or the main body side of the apparatus is such that the cartridge cannot be mounted. That is, the cartridge or the main body of the apparatus has a wrong insertion preventing function. The function of the cartridge differs depending on the specification, type, etc., of the apparatus. On the other hand, there are cartridges similar in appearance due to the commonness or the like of the their parts even if they are not fit for image formation in that apparatus. Therefore, if the erroneous mounting of a cartridge having no compatibility should be done, not only is good image formation not effected, but also trouble with the apparatus may be caused.

So, in the electrophotographic image forming apparatus, a construction for determining the compatibility of cartridges has heretofore been proposed and put into practice.

There is known, for example, a method using a sensor for discriminating compatibility, or a driving mechanism or the like which can mesh with only the driven gear of a matching process cartridge.

According to the conventional art, however, if a sensor for the judgment of compatibility is to be used, an expensive sensor for discrimination will be required. Also, it will be necessary to mount a part for operating the sensor also on the cartridge side, and this will result in an increase in cost.

Also, in the case of a construction for giving an incompatible function by the meshing engagement between gears, compatibility is discriminated near the mounted position of the cartridge. Therefore, the timing for the discrimination of compatibility is delayed.

SUMMARY OF THE INVENTION

The present invention has been made in view of the above-noted unsolved problem peculiar to the conventional art and an object thereof is to provide an electrophotographic image forming apparatus and a process cartridge which can reliably detect the incompatibility of the process cartridge by a simple construction.

Another object of the present invention is to provide a process cartridge and an electrophotographic image forming apparatus having a wrong mount preventing function of high reliability for the process cartridge.

Another object of the present invention is to provide a process cartridge and an electrophotographic image forming apparatus which can prevent a process cartridge not matching in function with the main body of the electrophotographic image forming apparatus from being mounted on a mounting portion provided in the main body of the apparatus.

Another object of the present invention is to provide a process cartridge and an electrophotographic image forming apparatus which enables only a cartridge matching in function with the main body of the electrophotographic image forming apparatus to be mounted on a mounting portion provided in the main body of the apparatus.

Another object of the present invention is to provide a process cartridge and an electrophotographic image forming apparatus which can prevent a process cartridge not matching in function with the main body of the electrophotographic image forming apparatus from being mounted on a mounting portion provided in the main body of the apparatus, by a simple construction.

Another object of the present invention is to provide a process cartridge and an electrophotographic image forming apparatus which permits a process cartridge matching in function with the main body of the electrophotographic image forming apparatus to be mounted on a mounting portion provided in the main body of the apparatus and in which a process cartridge not matching in function with the main body of the apparatus is hampered from being mounted on the mounting portion, by a portion of the process cartridge contacting a portion of the main body of the apparatus.

Another object of the present invention is to provide a process cartridge and an electrophotographic image forming apparatus which can prevent a process cartridge not matching in function with the main body of the electrophotographic image forming apparatus from being mounted on a mounting portion provided in the main body of the apparatus, by a shutter contacting a portion of the main body of the apparatus.

Another object of the present invention is to provide an electrophotographic image forming apparatus comprising a cartridge mounting portion for detachably mounting thereon a process cartridge provided with an electrophotographic photosensitive member, process means for acting on the electrophotographic photosensitive member, a shutter having a photosensitive member protecting portion for protecting the photosensitive member and movable between a protecting position for protecting the photosensitive member and a retracted position retracted from the protecting position to thereby expose the photosensitive member, and a shutter moving portion for moving the shutter from the protecting position to the retracted position, guide means for guiding the cartridge when the cartridge is to be mounted on the mounting portion, shutter opening means for coming into engagement with the shutter moving portion when the cartridge is guided by the guide means and is moved along a movement path toward the mounting portion, to thereby open the shutter from the protecting position to the retracted position, a wrong insertion preventing engagement portion adapted to be engaged with the shutter moving portion on the upstream side of an engagement position in which the shutter moving portion and the shutter opening means are engaged with each other, in the mounting direction in which the cartridge is mounted on the mounting portion when a cartridge not matching in function with the main body of the apparatus is inserted in the main body of the apparatus, to thereby open the shutter, and a main body shutter abutting portion adapted to abut against the shutter moved toward the retracted position by the shutter moving portion being engaged with the wrong insertion preventing engagement portion, to thereby restrict the insertion of the cartridge.

Another object of the present invention is to provide a process cartridge comprising an electrophotographic photosensitive member, process means for acting on the photosensitive member, a shutter having a photosensitive member protecting portion for protecting the photosensitive member and movable between a protecting position for protecting the photosensitive member and a retracted position retracted from the protecting position to thereby expose the photosensitive member, a shutter moving portion for coming into engagement with shutter opening means provided in the main body of an electrophotographic image forming apparatus when the cartridge is mounted on the main body of the apparatus, to thereby move the shutter from the protecting position to the retracted position, and adapted to be engaged with a wrong insertion preventing engagement portion provided in the main body of the apparatus, on the upstream side of an engagement position in which the shutter moving portion and the shutter opening means are engaged with each other, in the mounting direction in which the cartridge is mounted on the main body of the apparatus when the cartridge is inserted into the main body of the apparatus which does not match in function with the cartridge, to thereby move the shutter from the protecting position to the retracted position, and a cartridge shutter abutting portion provided on the shutter for abutting against a main body shutter abutting portion provided in the main body of the apparatus to restrict the insertion of the cartridge into the main body of the apparatus when the shutter is moved toward the retracted position by the shutter moving portion being engaged with the wrong insertion preventing engagement portion.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described with reference to the drawings.

General Structure

FIGS. 1 to 10 illustrate the general constructions of electrophotographic image forming apparatuses according to first to fifth embodiments of the present invention and a mounting and dismounting guide mechanism which is a mounting guide means for a process cartridge. Herein, the lengthwise direction of the process cartridge is a direction intersecting with (substantially orthogonal to) the direction in which the cartridge is mounted to and dismounted from the main body of the apparatus, and is a direction parallel to the surface of a recording medium and intersecting with (substantially orthogonal to) the transport direction of the recording medium. Also, right or left is right or left when the recording medium P is seen from above it in accordance with the transport direction of the recording medium. Also, the upper surface of the process cartridge is an overlying surface in a state in which the process cartridge is mounted to the main body of the apparatus, and the lower surface of the process cartridge is an underlying surface in the same state. The term "recording medium P" includes, for example, recording paper, OHP sheets, etc.

Figure 1:
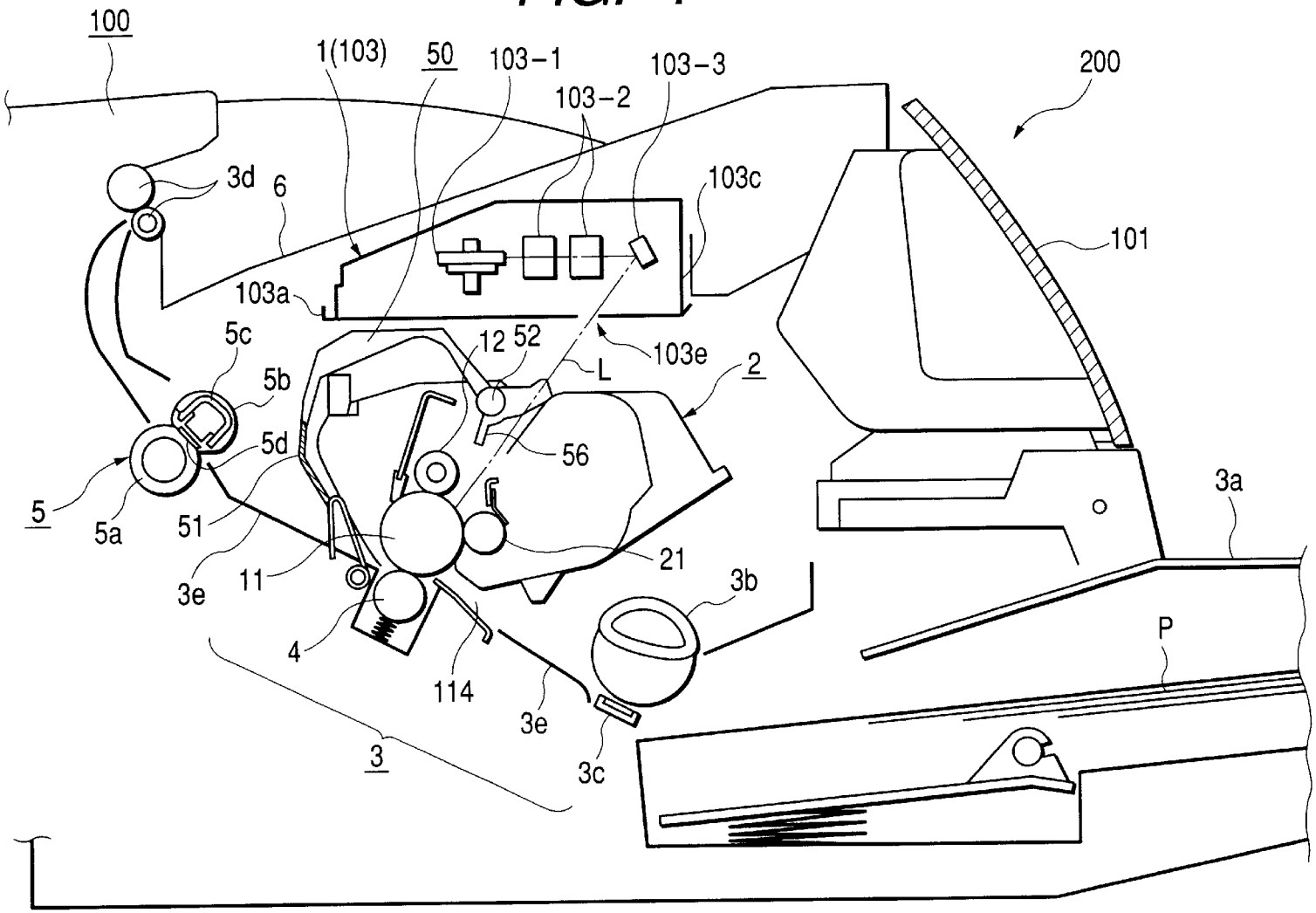
FIG. 1 illustrates the general construction of an electrophotographic image forming apparatus.

As shown in FIG. 1, the electrophotographic image forming apparatus (laser beam printer) applies information light based on image information from an optical system 1 as optical means to a photosensitive drum 11 which is a drum-shaped electrophotographic photosensitive member in a process cartridge 2 to thereby form an electrostatic latent image on the photosensitive drum 11. The electrostatic latent image is developed with a developer (toner) to thereby form a toner image. In synchronism with the formation of the toner image, recording media P are separated and fed one by one from the cassette 3*a* of a transporting system 3 by a pickup roller 3*b* and a pressure contact member 3*c* brought into pressure contact therewith. The toner image formed on the photosensitive drum 11 is transferred to the recording medium P by a voltage being applied to a transferring roller 4 as transferring means. The recording medium P is then transported to fixing means 5 by a transporting guide 3*f*.

The fixing means 5 has a drive roller 5*a* and a fixing rotary member 5*d* containing a heater therein and comprised of a cylindrical sheet rotatably supported by a supporting member 5*c*. It applies heat and pressure to the passing recording medium P to thereby fix the transferred toner image. The recording medium P is transported by delivery rollers 3*d* and is delivered to a delivery portion 6 through an inverter transport path.

An openable and closable member 101 and driving means for driving the transporting system 3, the fixing means 5 and the process cartridge 2 are disposed in the main body 100 of the image forming apparatus. The driving means drives each rotary member by a driving force transmitted from a motor (not shown) as a drive source to each rotary member through a gear train (not shown).

The driving force to the cartridge 2 is transmitted to a large gear (not shown) also through the aforementioned gear train. The transmission of the driving force between the large gear and the cartridge 2 is effected by the meshing engagement between a main body coupling 110 and a drum coupling 15. The main body coupling 110 (see FIG. 6) has a twisted-hole having a substantially equilateral triangular cross-section formed coaxially with the rotary shaft of the large gear. Also, the drum coupling 15 (see FIG. 3) has a twisted-protrusion having a substantially equilateral triangular cross-section provided on a gear flange fixed to one end portion of the photosensitive drum 11, coaxially with the rotary shaft of the photosensitive drum 11. The transmission of the driving force and the alignment and positioning of the large gear and the photosensitive drum 11 are effected by the connection of these couplings.

Internal Structure of the Process Cartridge

The process cartridge 2 has the photosensitive drum 11 which is an electrophotographic photosensitive member and developing member 20 as process means for acting thereon, namely, for developing the electrostatic latent image formed on the photosensitive drum 11.

Figure 2:
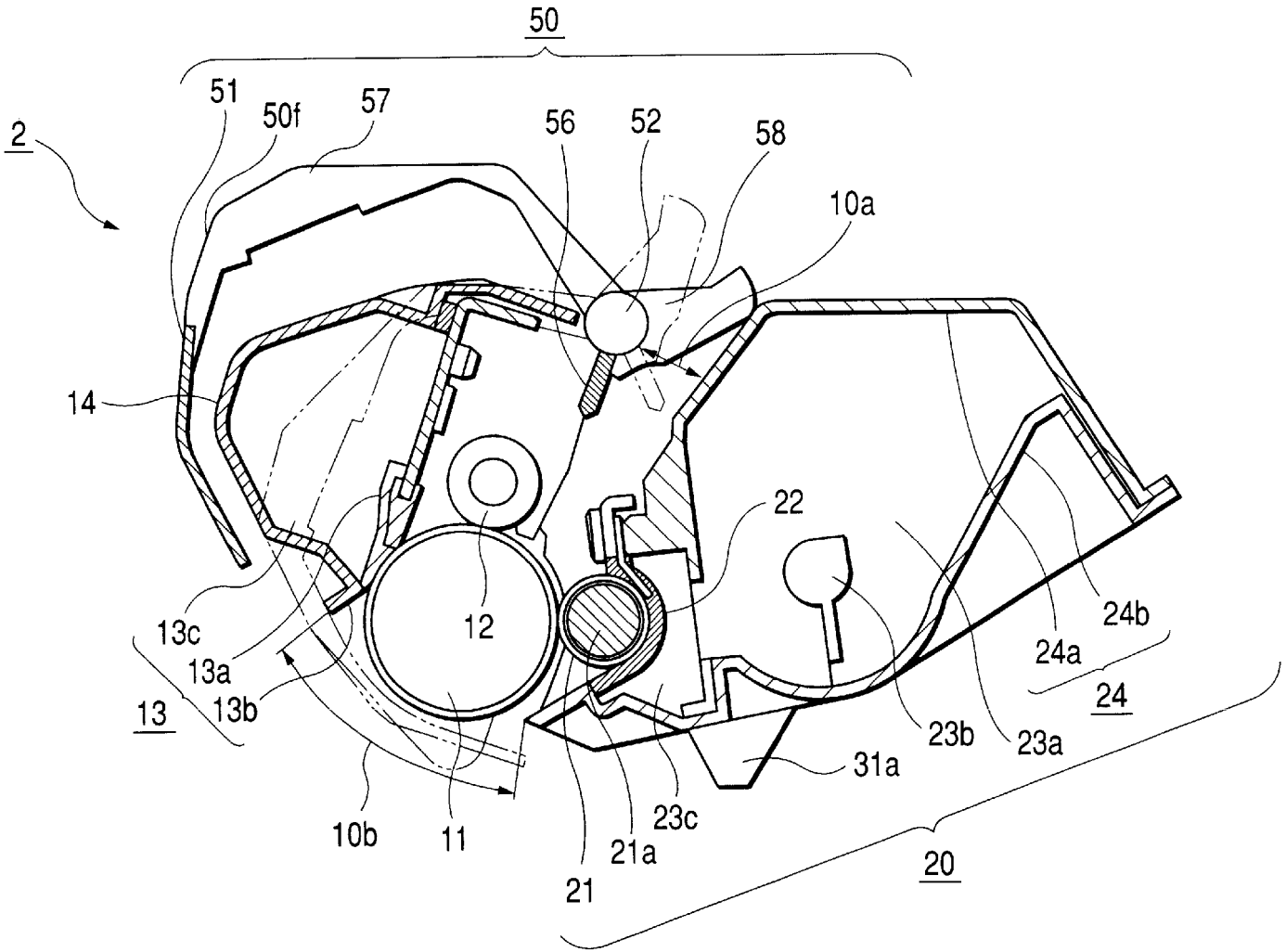
FIG. 2 is a typical cross-sectional view showing the process cartridge of FIG. 1.

As shown in FIG. 2, the cartridge 2 rotates the photosensitive drum 11 having a photoconductive layer, and applies a voltage to a charging roller 12 as charging means to thereby uniformly charge the surface of the photosensitive drum 11. The charged photosensitive drum 11 is exposed to information light (light image) L based on image information from the optical system 1 through an exposure opening portion 10*a*. Thereby, an electrostatic latent image is formed on the surface of the photosensitive drum 11. The electrostatic latent image is then developed by the developing means 20.

The developing means 20 is such that a developing roller 21 which is a developer bearing member containing a stationary magnet 21*a* therein is rotated and a toner layer given triboelectrification charges by a developing blade 22 is formed on the surface of the developing roller 21. The toner is shifted to the photosensitive drum 11 in conformity with the latent image to thereby form a toner image.

A voltage opposite in polarity to the toner image is then applied to the transferring roller 4 to thereby transfer the toner image to the recording medium P. Thereafter, any toner residual on the photosensitive drum 11 is scraped off by a cleaning blade 13*a*. The removed toner is dipped by a dip sheet 13*b* and is collected into a removed toner containing portion 13*c*. The residual toner on the photosensitive drum 11 is removed by cleaning means 13 of such a construction.

As described above, the cartridge 2 has a cleaning frame 14 rotatably supporting the photosensitive drum 11 and provided with the cleaning means 13 and the charging roller 12, and a developing frame provided with the developing roller 21, a toner containing portion 23*a*, a toner agitating member 23*b* and a developing chamber 23*c*. The developing frame 24 is supported for pivoted movement relative to a cleaning frame (drum frame) 14 so that the developing roller 21 of the developing means can be opposed to the photosensitive drum 11 in parallel thereto with a predetermined spacing between them. Spacers (not shown) for maintaining the spacing between the developing roller 21 and the photosensitive drum 11 are disposed on the opposite end portions of the developing roller 21.

Figure 3:
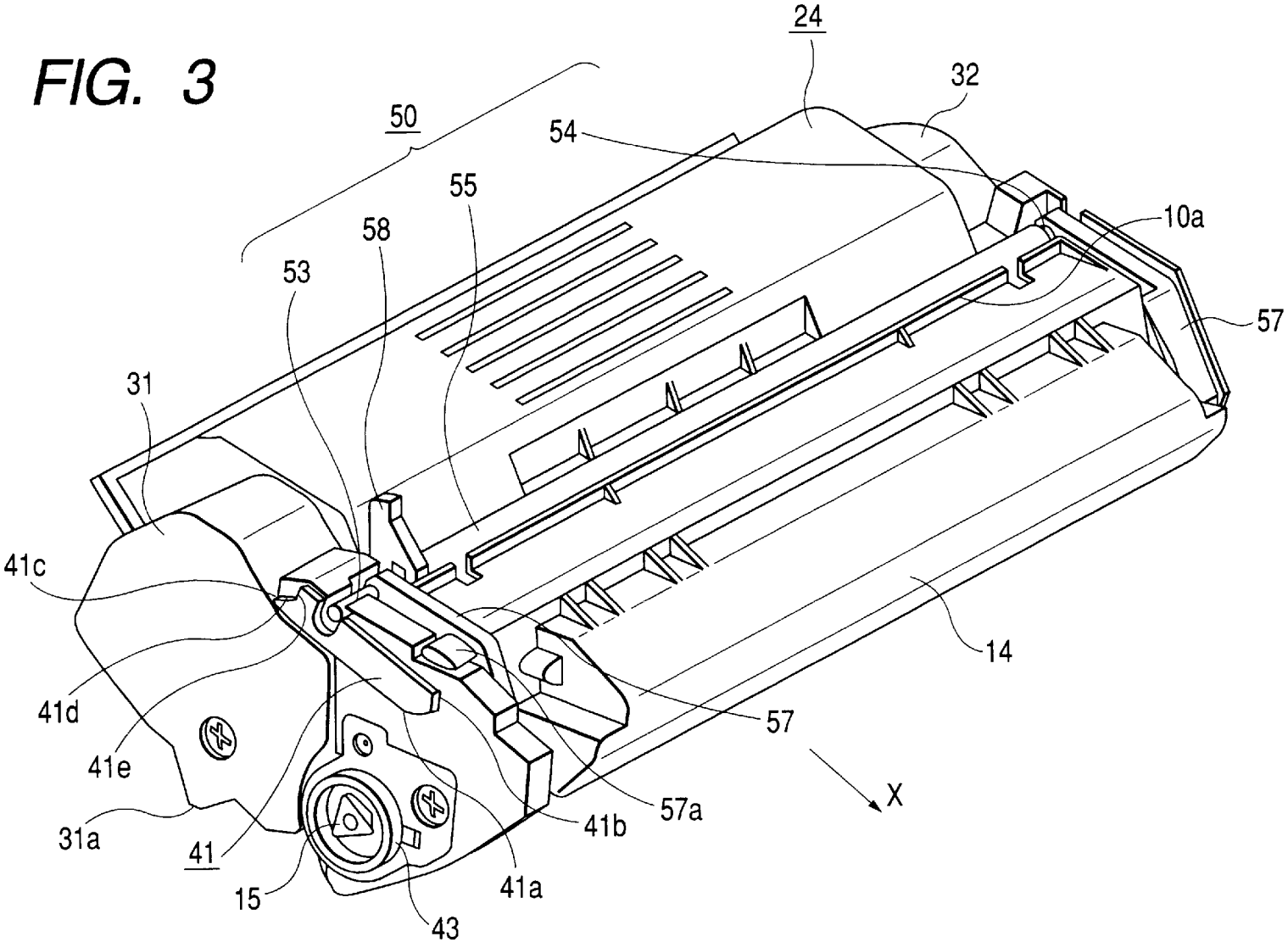
FIG. 3 is a perspective view of the process cartridge of FIG. 1 as it is seen from the right side thereof (the rear as viewed in the figure).

As shown in FIG. 3, holder members 31 and 32 are disposed on the opposite sides of the developing frame 24. These holder members 31 and 32 have suspending arms formed with coupling holes for rotatably suspending the developing frame 24 on the cleaning frame 14. A predetermined pressure force is applied to between the developing frame 24 and the cleaning frame 14 by a spring (not shown) to maintain a spacing therebetween.

Figure 4:
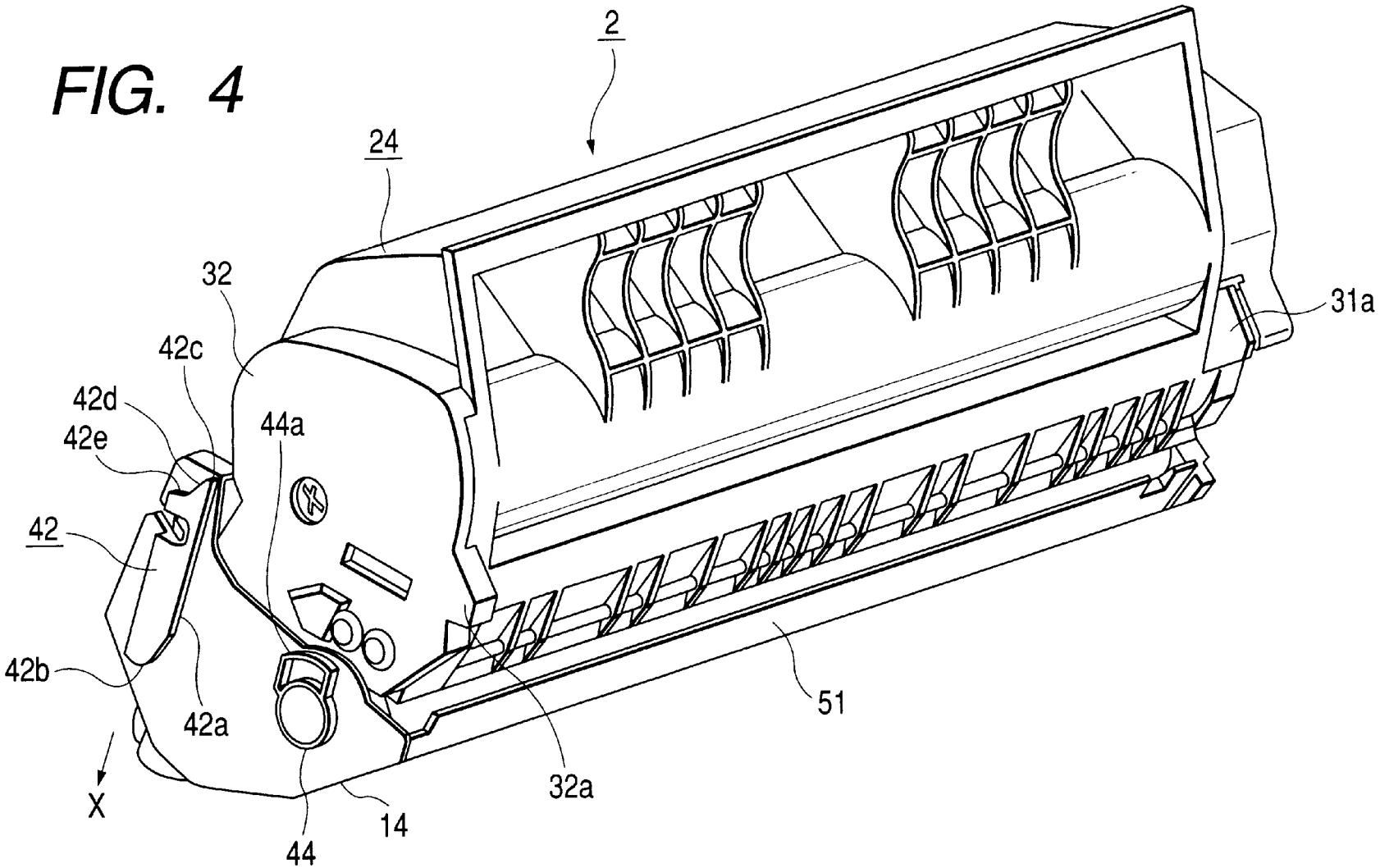
FIG. 4 is a perspective view of the process cartridge of FIG. 1 as it is seen from the left side thereof (the side as viewed in the figure).
Figure 5:
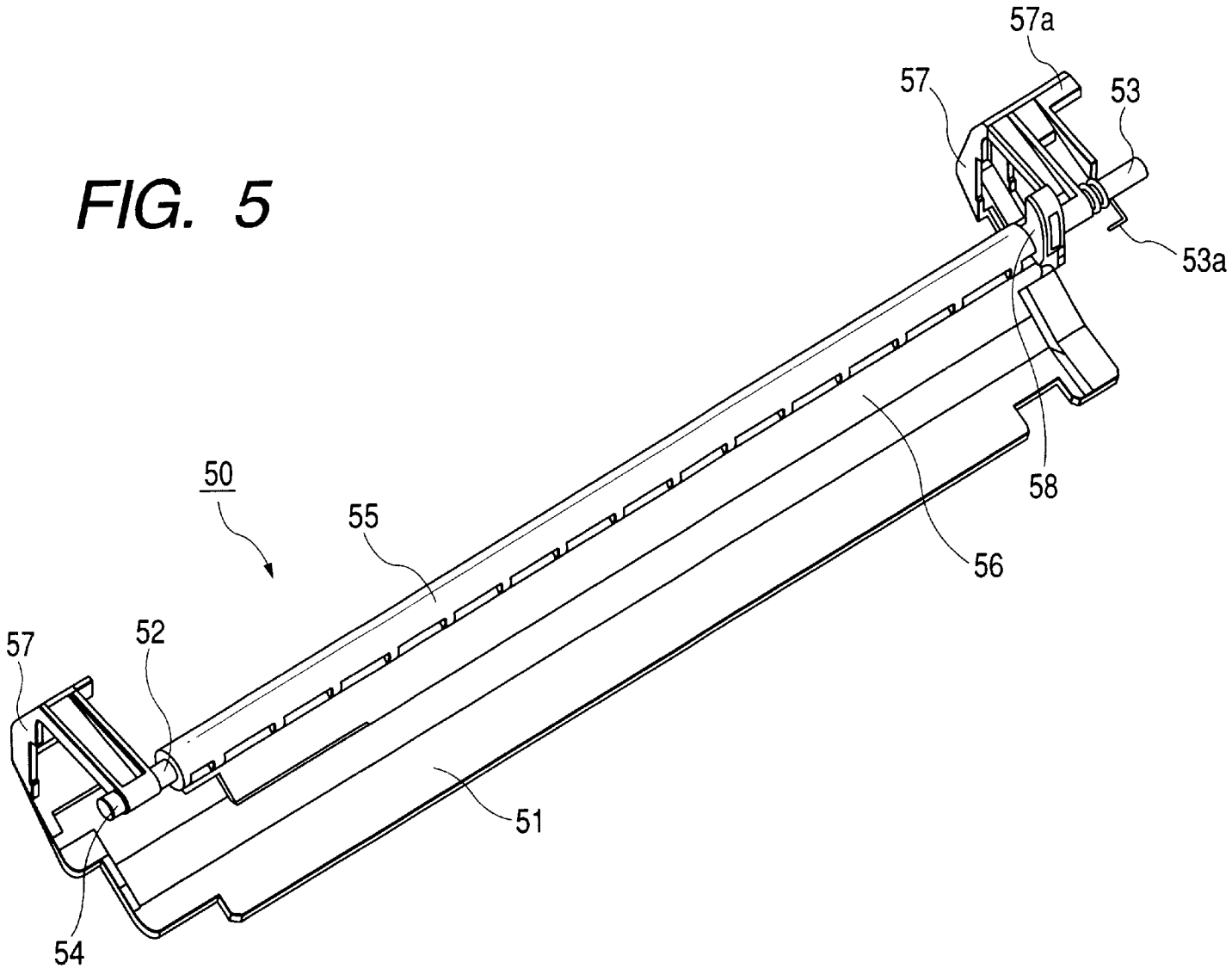
FIG. 5 is a perspective view showing only a drum shutter.

The cartridge 2 is constituted by the developing frame 24 comprising a developing frame member 24*a* and a lid member 24*b* welded together into a unit and the cleaning frame 14 coupled together by the holder members 31 and 32. On the lengthwisely opposite sides of the cartridge, as shown in FIGS. 3 and 4, there are provided mounting guides 41 and 42 for detachably mounting the cartridge to the main body 100 of the image forming apparatus of FIG. 1 in the direction indicated by the arrow X. Also, there are provided positioning guides 43 and 44 lying coaxially with the rotary shaft of the photosensitive drum 11 and supported by positioning means provided in the main body 100 of the apparatus. The positioning guides 43 and 44 are cylindrical bosses differing in diameter from each other. The positioning guide 44 on the side opposite to the driving side is provided with a mounting auxiliary guide 44*a* extended rearwardly in the mounting direction of the cartridge.

The mounting guides 41 and 42 are provided with lower surfaces 41*a* and 42*a* received by a moving guide 111 (guide means; see FIG. 6) provided in the main body 100 of the apparatus, and distal end portions 41*b* and 42*b* are provided on the distal end sides of the mounting guides 41 and 42 in the direction of insertion of the cartridge (the direction indicated by the arrow X). These distal ends 41*b* and 42*b* have their arcs connected to the lower surfaces 41*a* and 42*a* made larger than their arcs connected to the upper surfaces.

Also, slope portions 41*d* and 42*d* having their contained angle with the lower surfaces 41*a* and 42*a* made acute are provided on rear end lower corners 41*c* and 42*c* provided on the rear end corners of the lower surfaces 41*a* and 42*a* in the direction of insertion thereof. The rear end portions of the upper surfaces in the direction of insertion have orthogonal surfaces 41*e* and 42*e* orthogonal to the upper surfaces. The rear ends of the mounting guides 41 and 42 are provided to the rear of the centroidal position of the cartridge 2. When the cartridge 2 is supported by the guides 41 and 42, the cartridge always maintains its forwardly downward posture. The guides 41 and 42 are provided on the side of the frame 14 above the guides 43 and 44.

In the cartridge 2, as shown in FIG. 2, a drum shutter 50 which is a shutter capable of integrally covering the transfer opening portion 10*b* and the exposure opening portion 10*a* of the photosensitive drum 11 which are opposed to the transferring roller 4 is rotatably provided on the cleaning frame (drum frame) 14. The shutter 50 is not limited to that in the present embodiment, but may be, for example, one which openably and closably covers only the transfer opening portion 10*b* or only the exposure opening portion 10*a*.

As shown in FIGS. 2 to 5, the shutter 50 has a drum protecting portion 51 which is a photosensitive member protecting portion capable of covering the transfer opening portion 10*b* through which the photosensitive drum 11 contacts with the transferring roller 4, a rotary shaft 52 to be rotatably supported in that portion of the cleaning frame 14 which is near the exposure opening portion 10*a*, and sliding portions 53 and 54 sliding on the opposite ends of the rotary shaft 52 relative to the cleaning frame 14. In a portion connecting the sliding portions 53 and 54 on the opposite ends together, there is provided a large-diametered portion 55 thicker than the sliding portions 53 and 54, and an exposure shutter portion 56 for closing the exposure opening portion 10*a* when the shutter 50 is in its closed state. Further, the shutter 50 is provided with connecting portions 57 provided at two right and left locations for connecting the protecting portion 51 and the rotary shaft 52 together at the opposite end portions of the former and outside the latter, and a cam portion 58 which is a shutter moving portion disposed on the right end of the rotary shaft 52 and protruding to the upper side of the cartridge 2. Furthermore, there is provided a rib 57*a* provided on the right connecting portion 57 and extending outwardly in the lengthwise direction of the shutter 50. The rib 57*a* is received by the shutter guide of the main body of the apparatus and holds the shutter 50 in its opened posture.

A biasing force is applied to the shutter 50 by a torsion coil spring 53*a* (FIG. 5) in a direction in which the shutter 50 covers the photosensitive drum 11. Thereby, in a state in which the cartridge 2 is being taken out of the main body 100 of the apparatus, the shutter 50 maintains its closed state for covering the transfer opening portion 10*b*, as indicated by dots-and-dash line in FIG. 2. In a state in which the cartridge 2 is in the main body 100 of the apparatus and is capable of performing the image forming operation, the shutter 50 is rotated by a drum shutter opening and closing mechanism which will be described later, and exposes the transfer opening portion 10*b* as indicated by the solid line in FIG. 2 and assumes its opened posture in which the photosensitive drum 11 and the transfer roller 4 can contact with each other.

That is, the shutter 50 has a photosensitive member protecting portion for protecting the photosensitive member, and is movable between a protecting position for protecting the photosensitive member and a retracted position retracted from the protected position to thereby expose the photosensitive member.

The operation of mounting the cartridge 2 will now be described with reference to FIGS. 6 to 10.

Figure 6:
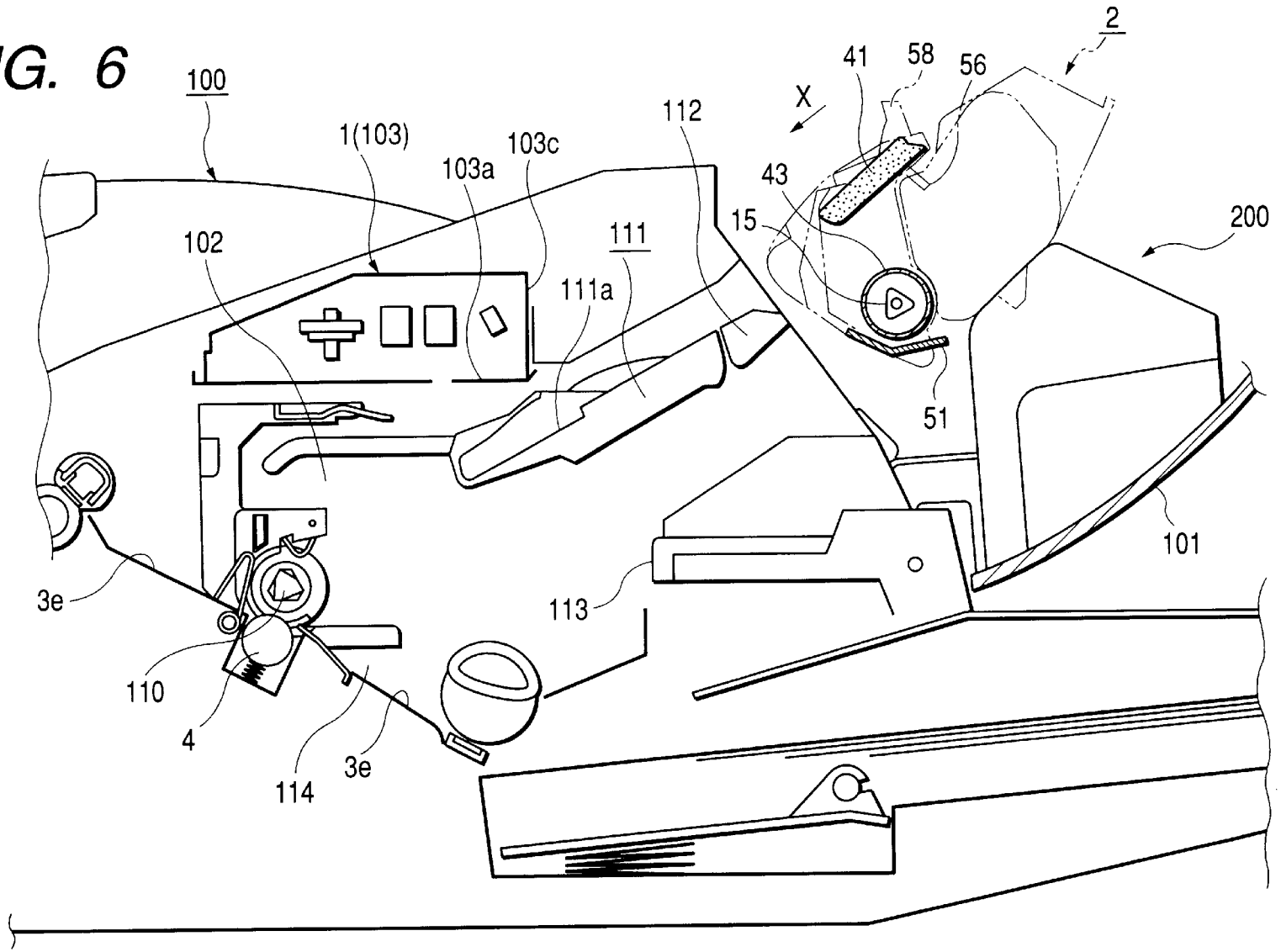
FIG. 6 illustrates the first step of inserting the process cartridge into the main body of the apparatus.

When the openable and closable member 101 of the main body 100 of the apparatus is completely opened (fully opened), a main body opening portion 200 for mounting and dismounting the cartridge 2 therethrough appears. In this state, as shown in FIG. 6, it appears in a posture in which right and left movable guides 111 in the main body 100 of the apparatus are lowered to the inner side with respect to the direction of insertion of the cartridge 2. On the upstream side of the movable guides 111 with respect to the direction of insertion, auxiliary guides 112 are fixed to main body side plates 102 substantially symmetrically at right and left.

As previously described, the positioning guides 43 and 44 and the rib-shaped mounting guides 41 and 42 have a shape along the direction in which the cartridge 2 is mounted and dismounted. Further, projected portions 31*a* and 32*a* protruding from the bottom surface of the developing frame 24 are provided on holder members 31 and 32, respectively, at the lengthwisely opposite ends (see FIG. 4).

As the cartridge 2 is inserted through the opening portion of the main body 100 of the apparatus, the mounting guides 41 and 42 of the cartridge 2 are received by the right and left movable guides 111 and auxiliary guides 112 in the main body of the apparatus.

The cartridge 2 is mounted on the main body 100 of the apparatus in a direction intersecting with the photosensitive drum 11 with the developing frame 24 trailing the cleaning frame 14 (or with the cleaning frame 14 disposed forwardly and the developing frame 24 disposed rearwardly). At this time, the shutter 50 is retracted forwardly of the cleaning frame 14. That is, the shutter 50 is retracted forwardly in the mounting direction.

Figure 8:
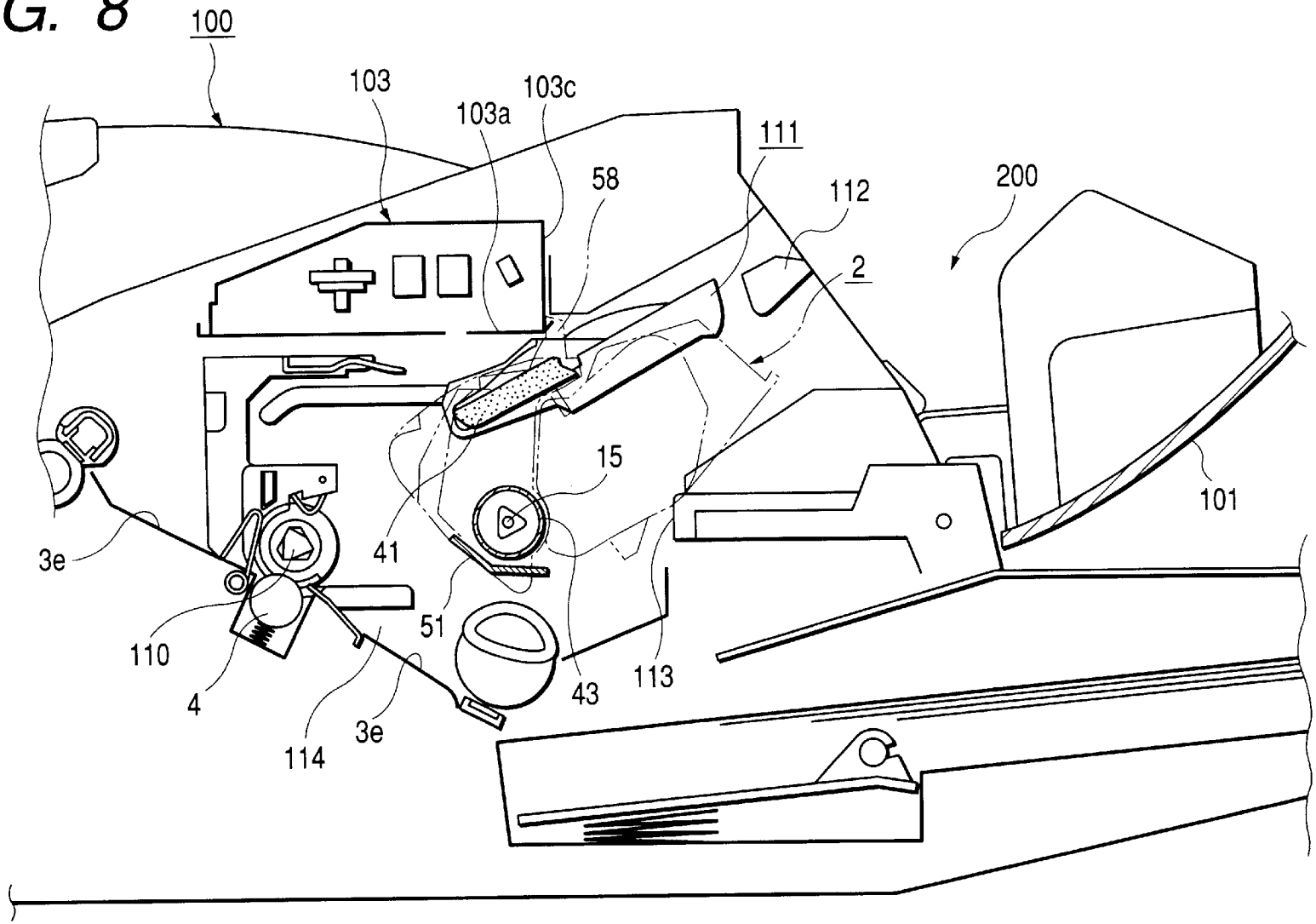
FIG. 8 illustrates the third step of inserting the process cartridge into the main body of the apparatus.

As shown in FIG. 8, with the cartridge 2 inserted in the main body 100 of the apparatus, the lower surface of the developing frame 24 contacts with the abutting rib 113 in the main body 100 of the apparatus rearwardly of the centroidal position of the cartridge 2 in the direction of insertion. Therefore, the cartridge 2 assumes a posture in which it raises the developing frame 24, which is on the rear side (upstream side) in the mounting direction. Therefore, the cartridge 2 inserted through the main body opening portion 200 has the lower sides of the distal ends 41*b* and 42*b* of the guides 41 and 42, respectively, supported by the guide groove 111*a* of the guide 111 and has the lower surface of the developing frame 24 supported by the abutting rib 113. Also, the lower corners 41*c* and 42*c* of the mounting guides 41 and 42, respectively, are raised.

The guide 111 is moved to the inner part of the main body 100 of the apparatus in operative association with the opening and closing operation of the openable and closable member 101. Therefore, when the cartridge 2 comes into engagement with the rear end (the end surface adjacent to the openable and closable member) of the guide 111, the guide 111 escapes into the interior of the main body 100 of the apparatus. So, it becomes impossible to put the mounting guides 41 and 42 of the cartridge 2 into the guide groove 111*a* of the guide 111. In order to prevent this, an auxiliary guide 112 constituting a mounting and dismounting auxiliary portion fixed to the side plate 102 of the main body and connected to the rear end of the guide 111 is provided upstream of the guide 111 in the mounting direction (the direction indicated by the arrow X) of the cartridge 2. The above-noted problem is solved by the auxiliary guide 112, and the mounting guides 41 and 42 of the cartridge 2 are reliably guided to the guide groove 111*a*.

The state in which the cartridge 2 is moved in operative association with the rotation of the openable and closable member 101 has hitherto been described. A description will now be provided of the opening and closing operation of the shutter 50 resulting from the movement.

Figure 7:
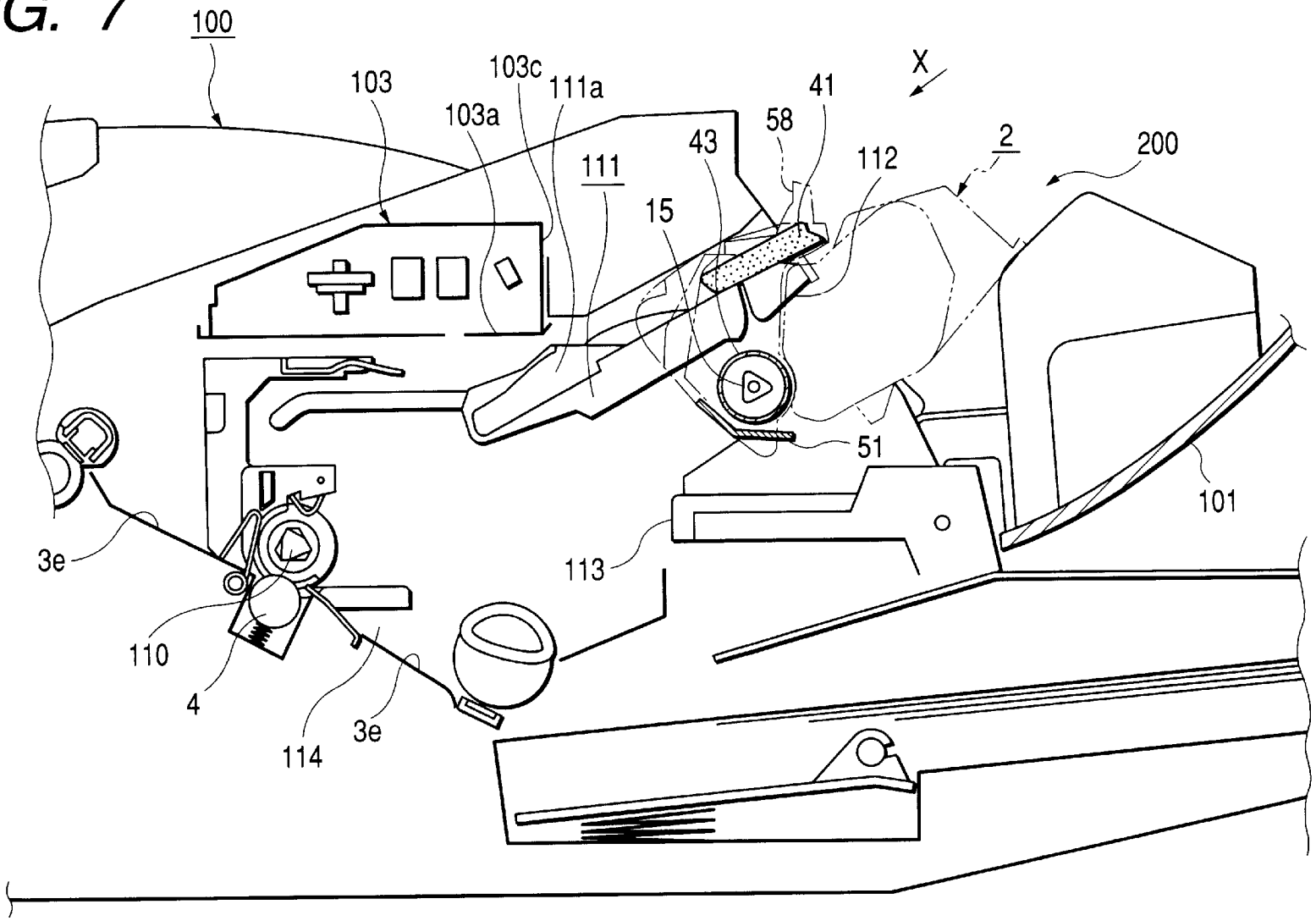
FIG. 7 illustrates the second step of inserting the process cartridge into the main body of the apparatus.
Figure 9:
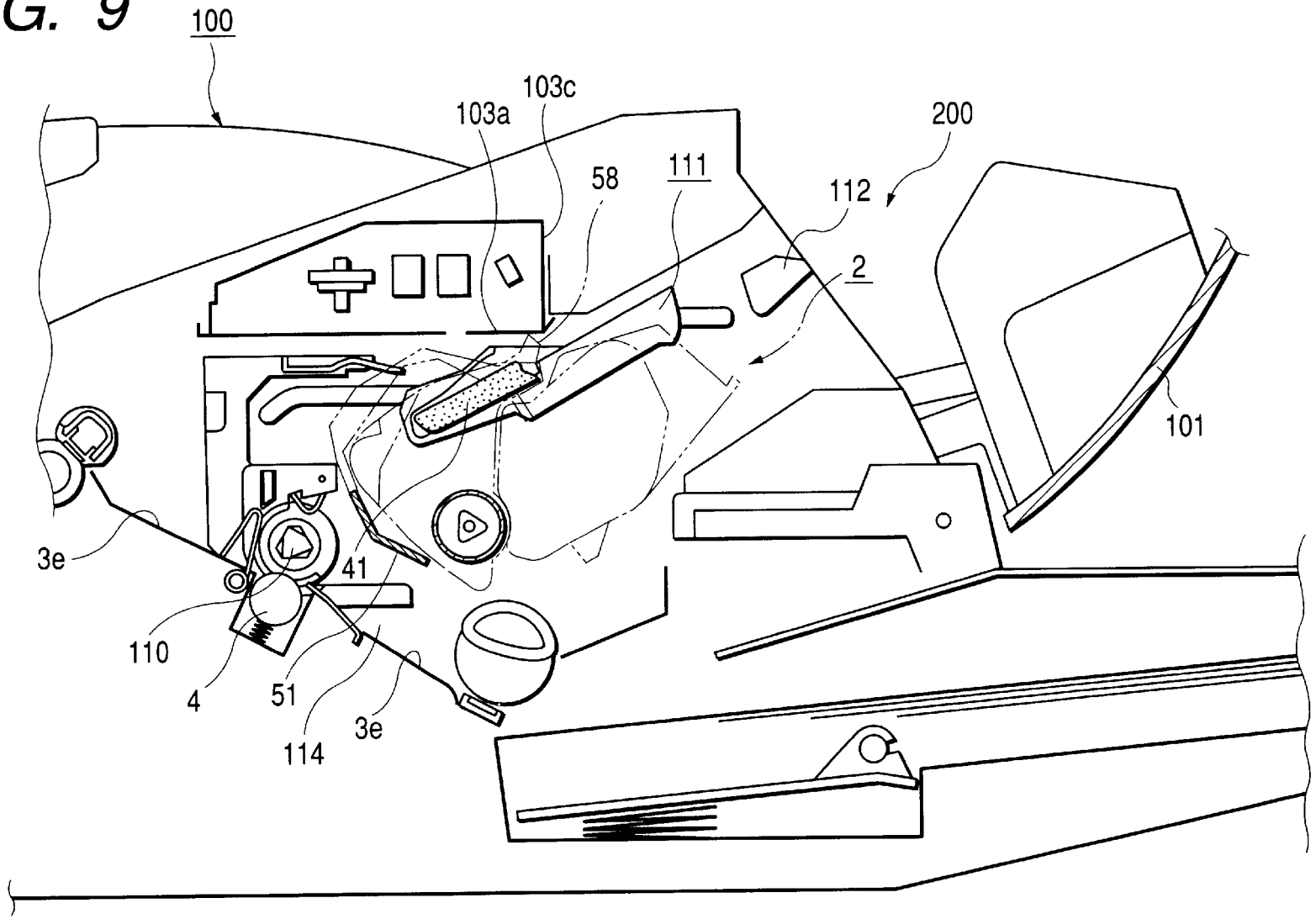
FIG. 9 illustrates the fourth step of inserting the process cartridge in operative association with the operation of closing the openable and closable member of the main body of the apparatus.
Figure 10:
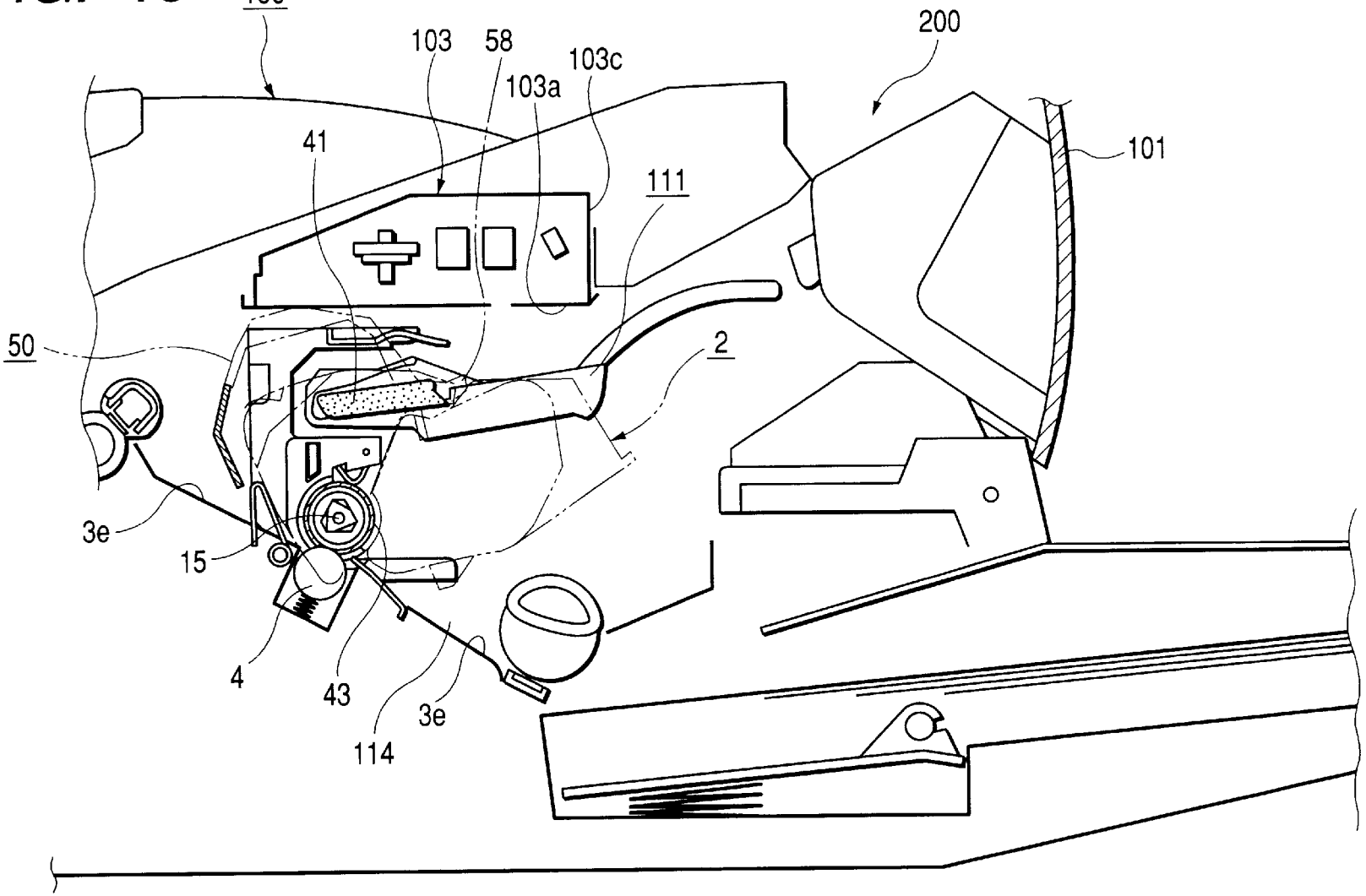
FIG. 10 illustrates the fifth step of inserting the process cartridge into the final position in operative association with the operation of closing the openable and closable member of the main body of the apparatus.

The opening and closing operation of the shutter 50, as shown in FIGS. 6, 7 and 8, is not performed at a stage whereat the cartridge 2 is mounted on the main body 100 of the apparatus, but is performed at a stage whereat the cartridge 2 is moved in the interior of the main body of the apparatus with the rotation of the openable and closable member 101 (see FIGS. 9 and 10).

That is, the shutter 50 is opened at a stage whereat the cartridge 2 is moved with the closing operation of the openable and closable member 101.

When the cartridge 2 is moved to the inner part in operative association with the closing operation of the openable and closable member 101, the shutter 50 rotatably supported by the cartridge 2 is rotated to thereby expose the transfer opening portion 10*b* and the exposure opening portion 10*a* and bring the cartridge 2 into a state in which it can effect image formation.

Describing in detail, when the cartridge 2 is moved in operative association with the closing operation of the openable and closable member 101, as shown in FIG. 8, the cam portion 58 of the shutter 50 comes into contact with an optical unit 103 which is a shutter opening means loaded with the optical system 1 at a predetermined position in the main body 100 of the apparatus, or a supporting stand 103*a* which is the fixed stand therefor. The shutter 50 is then clockwisely rotated while resisting the resilient force of a shutter spring 53*a*. Thereby, the transfer and exposure opening portions begin to be exposed.

As the cartridge 2 is moved toward the inner part, the cam portion 58 of the shutter 50 contacts with the corner of the optical unit 103 or the supporting stand 103*a*, and thereafter is moved while having the vertex portion of its distal end made to abut against the lower surface of the optical unit 103 or the supporting stand 103*a* (FIG. 9). As the cartridge 2 lowers toward the frame 3*e* of the transporting system 3, the shutter 50 makes its angle of opening greater.

The movement of the guide 111 operatively associated with the rotation of the openable and closable member 101 is stopped, and the transportation of the cartridge 2 resulting therefrom ends. Thereupon, as shown in FIG. 10, the shutter 50 assumes a predetermined angle of opening. The opening portion 10*b* and the opening portion 10*a* (FIG. 2) are exposed, and the cartridge 2 becomes capable of performing the image forming operation.

First Embodiment

Figure 11:
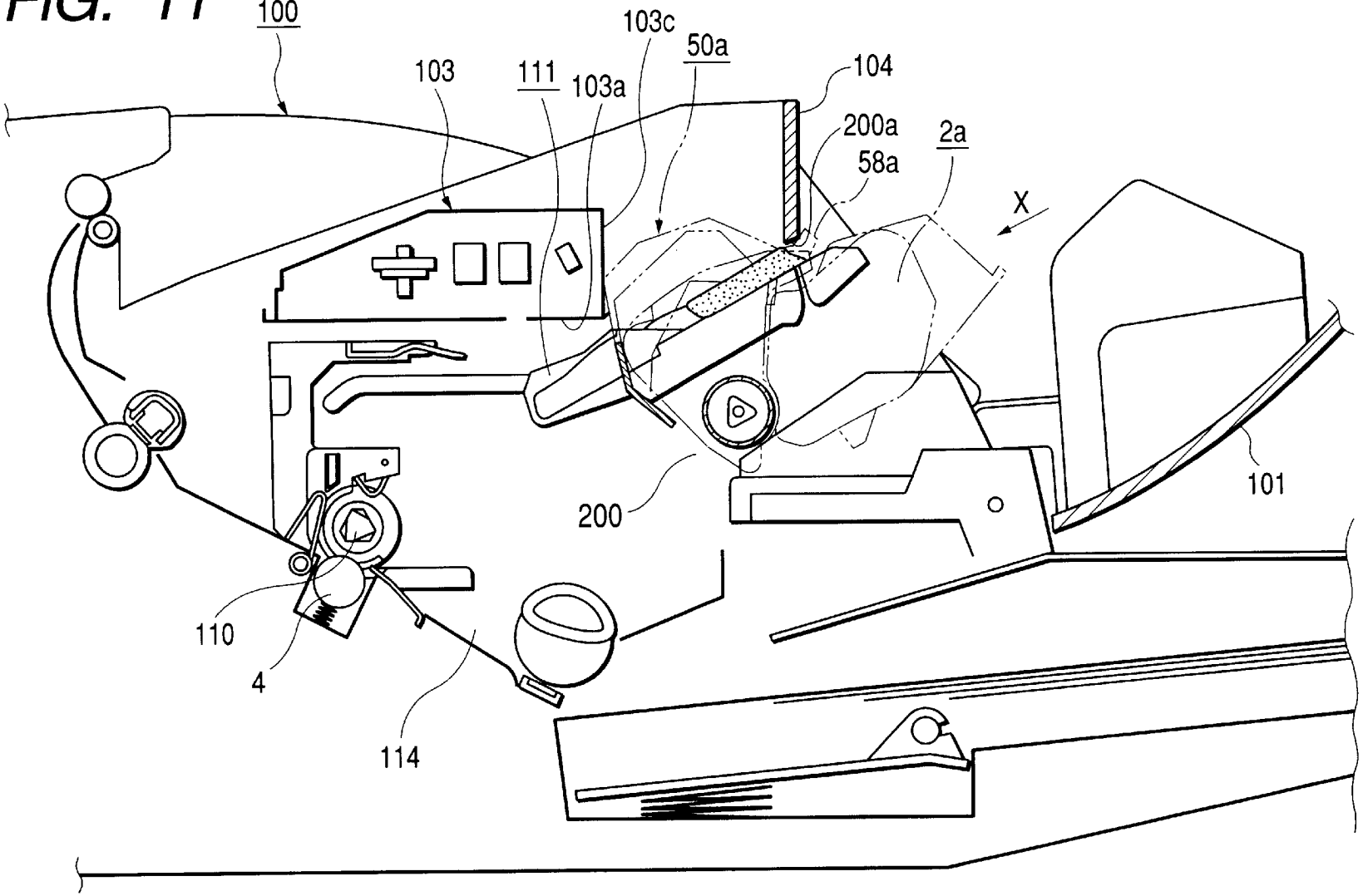
FIG. 11 illustrates a first embodiment.

FIG. 11 shows a first embodiment. This is provided with a wrong insertion preventing mechanism for preventing an improper cartridge 2*a* which does not match in function with the apparatus from being inserted into an electrophotographic image forming apparatus having the above-described general structure. This preventing mechanism is provided with a wrong insertion preventing engagement portion (interfering means) 104 such as a rib or a wall on the upper peripheral edge of the opening portion 200 of the main body 100 of the apparatus. When the improper cartridge 2*a* is inserted, the cam portion (shutter moving portion) 58*a* of the shutter 50*a* comes into engagement with the wrong insertion preventing engagement portion 104 and is rotatively driven. Thereby, the shutter 50*a* immediately after the insertion is opened.

The cam portion 58 (shutter moving portion) of the shutter 50 of a proper cartridge 2 which matches in function with the apparatus is provided at a lengthwise position different from that of the cam portion 58*a* of the shutter 50*a* of the improper cartridge 2*a*. So, the cam portion 58 does not come into engagement with the engagement portion 104 but is inserted into the inner part of the main body 100 of the apparatus. Then, the cam portion 58, as previously described, comes into engagement with the optical unit 103 which is shutter opening means, or the supporting stand 103a thereof in operative association with the operation of closing the openable and closable member 101, and opens the shutter 50 at a proper position. That is, it permits the cartridge 2 which matches in function with the apparatus to be mounted on the main body 100 of the apparatus. The optical unit 103 is a unit carrying thereon the optical system 1 comprised of a polygon mirror 103-1, a lens 103-2 and a mirror 103-3. This optical unit 103 is supported on the supporting stand 103*a*. The optical unit 103 is formed with an opening 103*e*. The opening 103*e* is for emitting therethrough a laser beam L to be applied to the photosensitive drum 11.

A wrong insertion preventing wall may be provided and may be formed with an opening portion formed with an opening portion excluded only on the locus of the cam portion 58 of the proper cartridge 2.

When the improper cartridge 2*a* is inserted (mounted) through the opening portion 200 of the main body 100 of the apparatus, the cam portion 58*a* of the shutter 50*a* abuts against the engagement portion 104 immediately thereafter. The shutter 50*a* is clockwisely rotated against the spring pressure of the spring 53*a* to thereby begin to open the transfer opening portion 10*b* and the exposure opening portion 10*a*, and the shutter 50*a* becomes opened.

As described above, immediately after being inserted, the improper cartridge 2*a* has its shutter 50*a* opened, and the opened shutter 50*a* strikes against the side 103*c* or the supporting stand 103*a* of the optical unit 103. Therefore, any further insertion of the improper cartridge 2*a* is blocked.

The improper cartridge 2*a* cannot be completely contained in the main body 100 of the apparatus and the openable and closable member 101 is not closed. Therefore, the image forming operation becomes impossible.

On the other hand, the design is made such that when the proper cartridge 2 is to be inserted, the engagement portion 104 does not interfere on the insertion locus of the cam portion 58 of the shutter. Therefore, the operation of opening the shutter 50 to a proper position and the image forming operation becomes possible.

Instead of adopting a construction in which a wall or the like for preventing wrong insertion is provided in the opening in the main body of the image forming apparatus to thereby enable only the cam portion of the shutter of the proper cartridge to pass, the number of the cam portions of the shutter may be increased to thereby cope with the problem. That is, a plurality of cam portions of the shutter may be provided in the lengthwise direction to thereby give a wrong insertion preventing mechanism similar to that described above.

According to the present embodiment, the positions of the cam portion of the shutter of the cartridge are made different in the lengthwise direction of the cartridge. Thus, the outer frame construction or the like of the cartridge is not changed greatly. Also, the number of parts is not increased as in a case where a sensor for detecting incompatibility is used. Further, the incompatibility of the cartridge can be given by a simple and inexpensive construction to thereby contribute to usability and a lower price.

Second Embodiment

Figure 12:
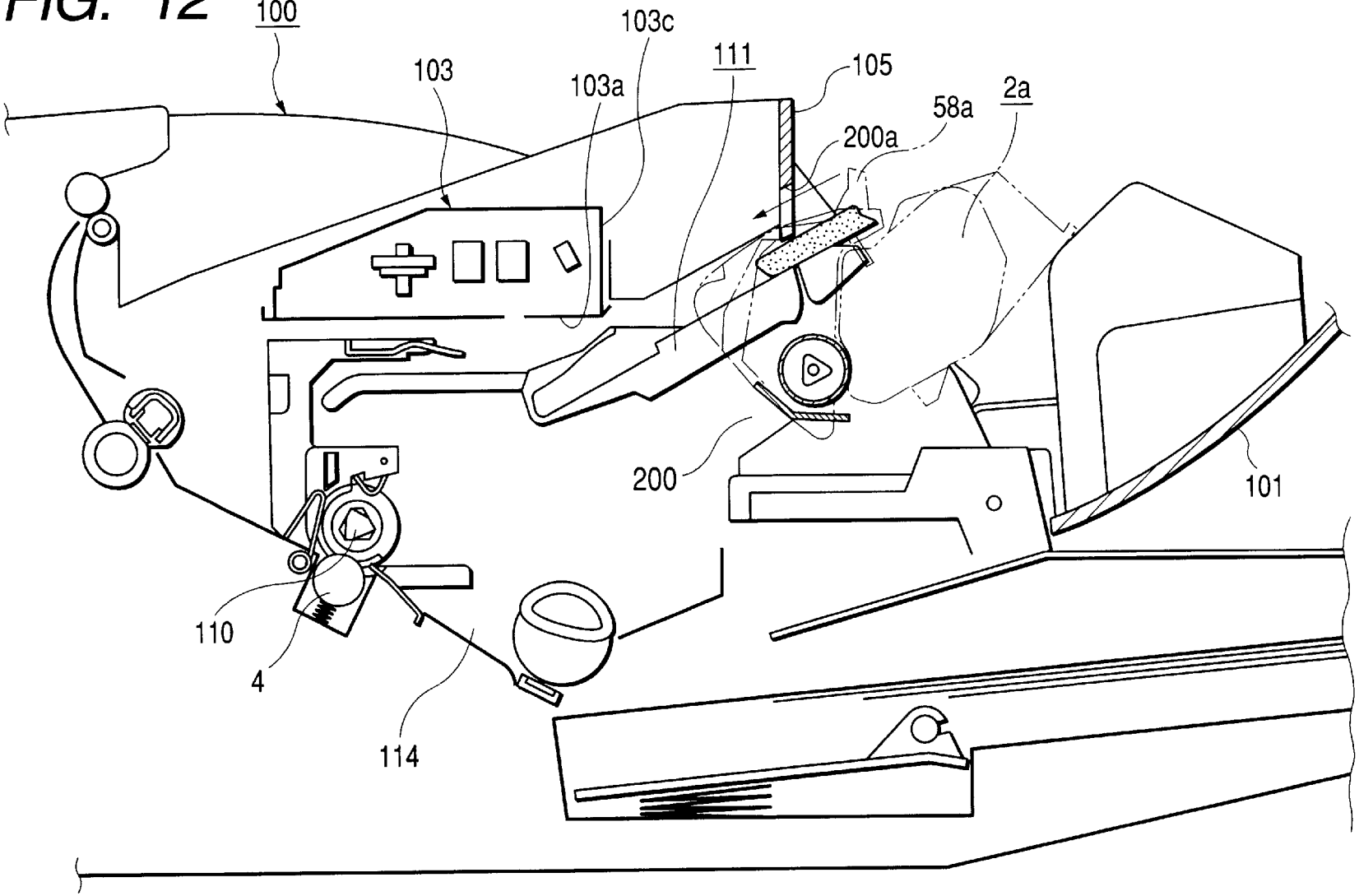
FIG. 12 shows a case where in a second embodiment, a proper process cartridge is inserted.
Figure 13:
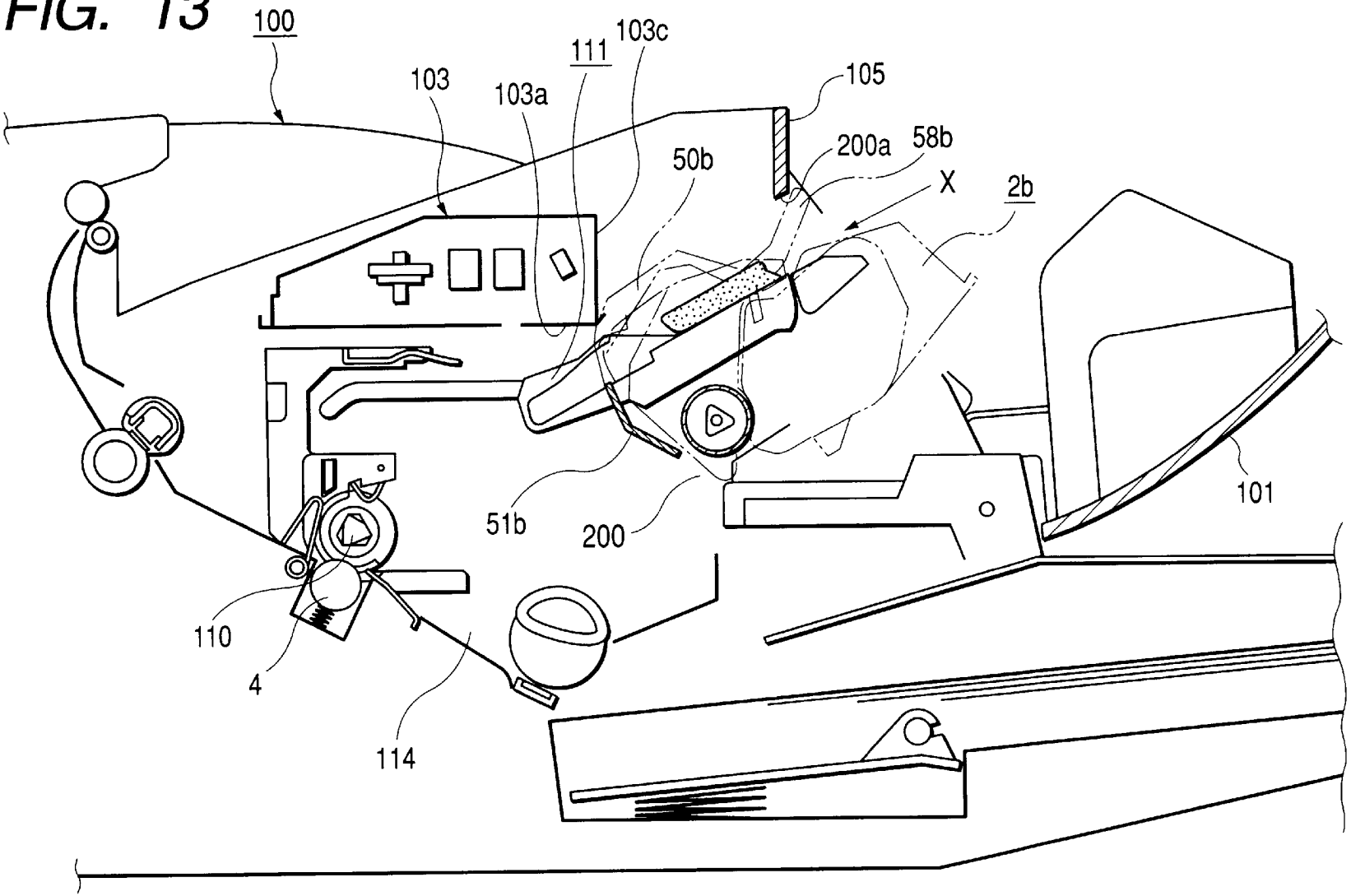
FIG. 13 shows a case where in the second embodiment, an improper process cartridge is inserted.
Figure 14:
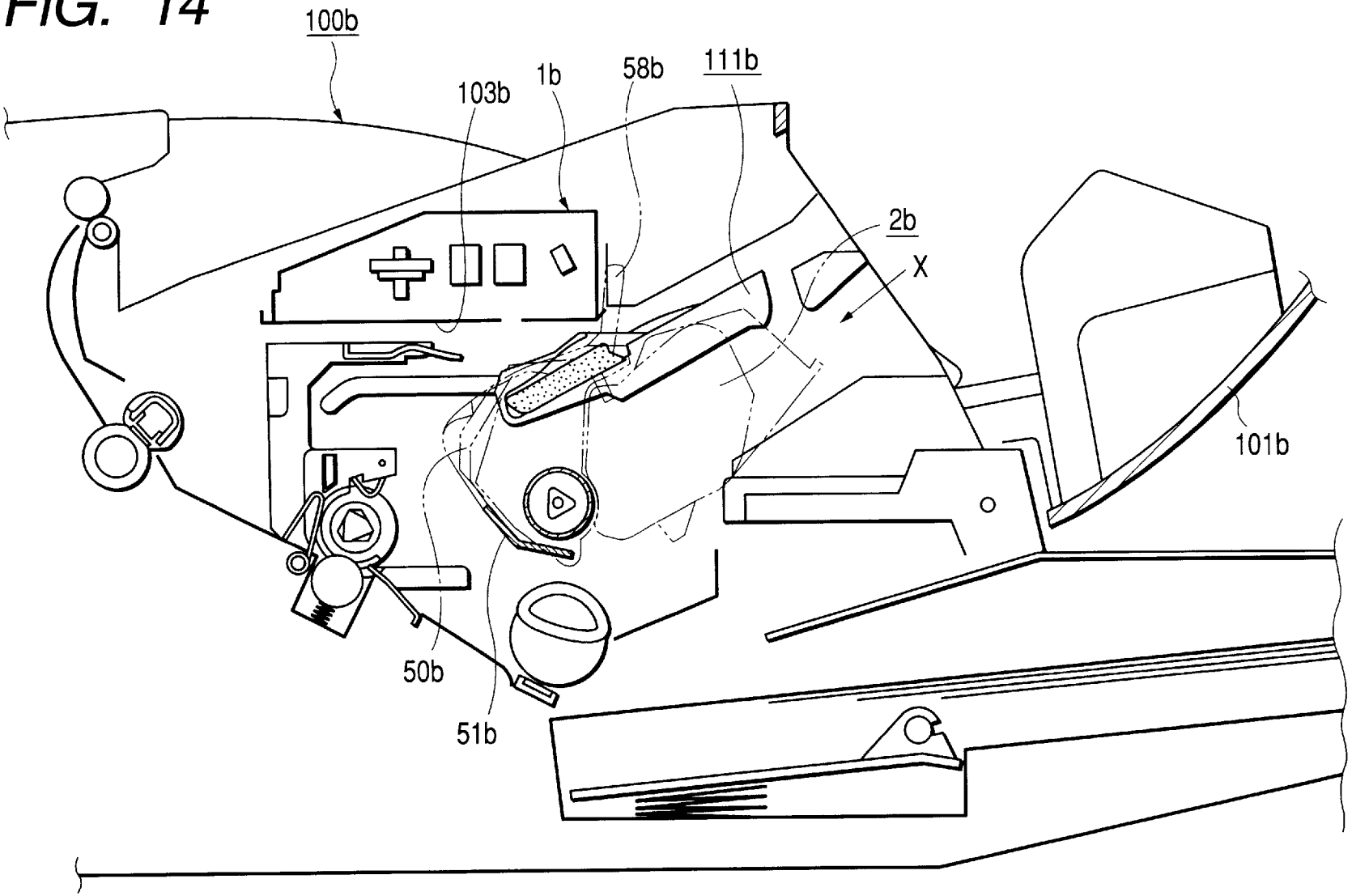
FIG. 14 illustrates one side compatibility in the second embodiment.

FIGS. 12 to 14 show a second embodiment.

In this embodiment, as a wrong insertion preventing mechanism for preventing an improper cartridge from being inserted, a wrong insertion preventing engagement portion 105 such as a rib or a wall is provided on the upper edge of the opening portion 200 of the main body 100 of the apparatus. The cam portion 58*a* of the shutter 50 of a proper cartridge 2*a* shown in FIG. 12 is free to pass through the opening portion. A long cam portion 58*b* provided on the shutter 50*b* of an improper cartridge 2*b* shown in FIG. 13 comes into engagement with the engagement portion 105 and is rotatively driven. Thereby the shutter 50*b* is opened.

That is, the cam portion 58*a* of the shutter 50 of the proper cartridge 2*a* does not come into engagement with the engagement portion 105, but is inserted into the inner part of the main body 100 of the apparatus. The shutter 50 is opened in operative association with the operation of closing the openable and closable member 101, as previously described.

When the improper cartridge 2*b* is to be inserted into the main body 100 of the apparatus, the cam portion 58*b* of the shutter 50*b* of the cartridge 2*b* is long. Therefore, it abuts against the engagement portion 105, and the shutter 50*b* performs its opening operation immediately after the cartridge 2*b* has been inserted. Then it strikes against the side (outer wall) 103*c* or the supporting stand 103*a* of the optical unit 103, and any further insertion is blocked.

As shown in FIG. 14, the main body 100*b* of an apparatus on which the cartridge 2*b* is mounted as a proper cartridge is provided with an opening portion sufficient to pass the cam portion 58*b* of the shutter 50*b* of the cartridge 2*b* therethrough. In the process of the cartridge 2*b* being inserted into the inner part with a guide 111*b* by the operation of closing an openable and closable member 101*b*, the cam portion 58*b* frictionally contacts with the optical unit 103 of an optical system 1*b* or the supporting stand 103*a*. Thereby, the shutter 50*b* is opened at a proper position. Then, as previously described, the protecting portion 51*b* or the like is opened.

The one side compatibility of the cartridge can be realized simply by changing the shape of the cam portion of the shutter of the cartridge.

That is, the present embodiment not only has action and effect equal to those of the first embodiment, but is effective when incompatibility is required only on one side.

The aforedescribed Embodiments 1 and 2 are summed up as follows.

The electrophotographic image forming apparatus for forming an image on a recording medium is an electrophotographic image forming apparatus comprising a cartridge mounting portion 114 for detachably mounting thereon a process cartridge 2 provided with a photosensitive drum 11, process means (at least one of charging means 12, cleaning means 13 and developing means 20) for acting on the photosensitive drum 11, a shutter 50 having a photosensitive member protecting portion (drum protecting portion 51) for protecting the photosensitive drum 11, and movable between a protecting position for protecting the photosensitive drum 11 and a retracted position retracted from the protecting position to thereby expose the photosensitive drum 11, and a shutter moving portion (cam portion 58) for moving the shutter 50 from the protecting position to the retracted position, guide means (guide 111) for guiding the cartridge 2 when the cartridge 2 is mounted on the mounting portion 114, shutter opening means (optical unit 103, supporting stand 103*a*) for coming into engagement with the shutter moving portion (cam portion 58) to thereby open the shutter 50 from the protecting position to the retracted position when the cartridge 2 is guided by the guide means (guide 111) and is moved along a movement path toward the mounting portion 114, a wrong insertion preventing engagement portion 104, 105 adapted to be engaged with the shutter moving portion (cam portion 58) and open the shutter 50 on the upstream side of an engagement position at which the shutter moving portion (cam portion 58) and the shutter opening means (optical unit 103, supporting stand 103*a*) are engaged with each other, in a mounting direction in which a cartridge 2, 2*a* not matching in function with the main body 100, 100*b* of the apparatus is mounted on the mounting portion 114, when the cartridge 2, 2*a* is inserted into the main body 100, 100*b* of the apparatus, and a main body shutter abutting portion (optical unit 103., supporting bed 103*a*) for abutting against the shutter 50 moved toward the retracted position by the shutter moving portion (cam portion 58) being engaged with the wrong insertion preventing engagement portion 104, 105, to thereby restrict the insertion of the cartridge 2.

The wrong insertion preventing engagement portion 104, 105 is a peripheral edge portion 200*a* located above an opening portion 200 provided in the main body 100 of the apparatus for inserting the cartridge 2, 2*a* into the main body 100 of the apparatus therethrough.

Also, the shutter abutting portion (optical unit 103, supporting stand 103*a*) is a portion of the outer wall 103*c* of the optical unit 103 containing therein an optical system for applying information light to the photosensitive drum 11, or/and a portion of the optical unit supporting stand 103*a*.

Also, the process cartridge 2 detachably mountable on the main body 100 of an electrophotographic image forming apparatus is a process cartridge having a photosensitive drum 11, process means (at least one of charging means 12, cleaning means 13 and developing means 20) for acting on the photosensitive drum 11, shutter 50 having a photosensitive member protecting portion (drum protecting portion 51) for protecting the photosensitive drum 11, and movable between a protecting position for protecting the photosensitive drum 11 and a retracted position retracted from the protecting position to thereby expose the photosensitive drum 11, a shutter moving portion (cam portion 58) for coming into engagement with shutter opening means (optical unit 103, supporting stand 103*a*) provided in the main body 100 of the apparatus to thereby move the shutter 50 from the protecting position to the retracted position when the cartridge 2 is mounted on the main body 100 of the apparatus, and coming into engagement with a wrong insertion preventing engagement portion 104, 105 provided in the main body 100 of the apparatus to thereby move the shutter 50 from the protecting position to the retracted position, on the upstream side of an engagement position at which the shutter moving portion (cam portion 58) and the shutter opening means (optical unit 103, supporting stand 103*a*) are engaged with each other, in the mounting direction in which the cartridge 2 is mounted on the main body 100 of the apparatus when the cartridge is inserted into the main body 100 of the apparatus which does not match in function with the cartridge 2, 2*a*, and a cartridge shutter abutting portion 50*f* provided on the shutter 50 for abutting against a main body shutter abutting portion (optical unit 103, supporting stand 103*a*) provided in the main body 100 of the apparatus to restrict the insertion of the cartridge 2, 2*a* into the main body 100 of the apparatus when the shutter 50 is moved toward the retracted position by the shutter moving portion (cam portion 58) being engaged with the wrong insertion preventing engagement portion 104, 105. The cartridge shutter abutting portion 50*f* is a portion of the outer surface of the shutter 50 (FIG. 2).

Third Embodiment

Figure 15:
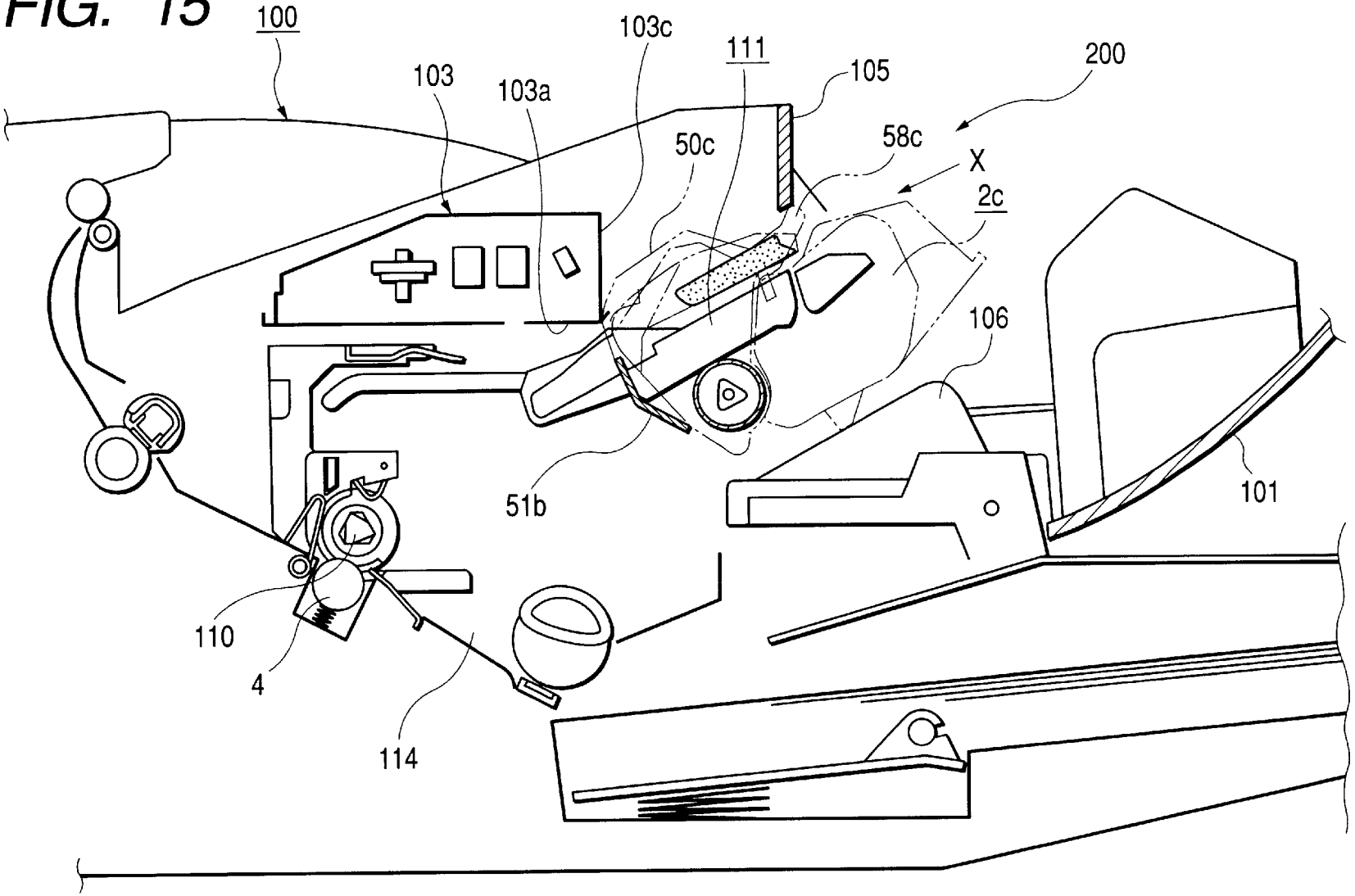
FIG. 15 illustrates a third embodiment.

FIG. 15 shows a third embodiment. In this embodiment, an insertion guide 106 which is wrong insertion preventing guide means for blocking the wrong insertion of an improper cartridge 2*c* and inserting only a proper cartridge 2 is provided in the main body 100 of the apparatus.

For example, the projected portions 31*a* and 32*a* (FIG. 4) of the bottom of the proper cartridge 2 are provided with concave shapes which are wrong insertion preventing guide portions for realizing an insertion locus without interfering with the insertion guide 106. Only when the improper cartridge 2*c* is inserted, the movement path is changed, and a drum shutter 50*c* is opened near the opening portion 200 of the main body and a drum protecting portion, etc., are opened to thereby prevent any further insertion.

A cut-away or the like can simply be provided in the bottom of the process cartridge. This leads to the advantage that it is not necessary to greatly change the size and shape of the frame of the cartridge. In the other points, the present embodiment is similar to the first embodiment.

Each of the aforedescribed embodiments to which the present invention is applied is constructed as described above and therefore achieves such effects as will be described below.

When a cartridge which does not match in function with the main body of the apparatus is mounted, the shutter opened near the opening portion of the main body of the apparatus strikes against the internal structure of the main body of the apparatus so that the cartridge cannot be inserted any further. Thereby, without resulting in any great change in design on the main body side of the apparatus and the cartridge side, reliable incompatibility can be given at a relatively low cost. Also, it can contribute to an improvement in usability.

Here, as the cases where the two do not match in function with each other, mention may be made of the discordance of the process speed of image formation, the presence or absence of the remaining amount detecting function of detecting the remaining amount of the developer, or the difference between a process cartridge for a facsimile apparatus and a cartridge for a laser beam printer, and a case where when a memory is carried on a cartridge, the main body of the apparatus is not provided with the function of effecting communication with the memory.

In the aforedescribed embodiments, the shutter opening means and the shutter abutting portion are used in common with each other. That is, any of them is the outer wall 103*c* of the optical unit 103 or the supporting stand 103*a* thereof. In the present invention, however, this is not restrictive, and the shutter opening means and the main body shutter abutting portion need not be used in common with each other. For example, any one of them may be a fixed wall provided in the main body 100 of the apparatus. Also, the two are not restricted to the optical unit 103 and the supporting stand 103*a*, but may be, for example, a fixed wall provided in the main body 100 of the apparatus. Also, the shutter moving portion is not restricted to the cam portion 58, but may be, for example, a portion of a link mechanism.

In other words, incompatibility is given by a simple and low-cost construction, whereby the sharing of the parts of the electrophotographic image forming apparatus can be expedited to thereby curtail the manufacturing cost.

As in the conventional art, a discriminating sensor or the like for giving incompatibility is not required, and the structure of not only the process cartridge but also the main body of the apparatus is not made complicated. The sharing of the assembling steps and an assembling apparatus among many parts and further, the diversion of the packaging form can also be realized.

According to the present invention, the highly reliable wrong mounting prevention of the process cartridge can be realized.

While the invention has been described with reference to the structure disclosed herein, it is not confined to the details set forth and this application is intended to cover such modifications or changes as may come within the purposes of the improvements or the scope of the following claims.

What is claimed is:

1. An electrophotographic image forming apparatus for forming an image on a recording medium, comprising:

a cartridge mounting portion configured and positioned to detachably mount thereon a process cartridge, the process cartridge including: an electrophotographic photosensitive member; process means for acting on the electrophotographic photosensitive member; a shutter having a photosensitive member protecting portion configured and positioned to protect the electrophotographic photosensitive member, and movable between a protecting position for protecting the electrophotographic photosensitive member and a retracted position retracted from the protecting position to expose the electrophotographic photosensitive member; and a shutter moving portion configured and positioned to move the shutter from the protecting position to the retracted position;

guide means for guiding the process cartridge when the process cartridge is to be mounted on said mounting portion;

shutter opening means for coming into engagement with the shutter moving portion to open the shutter from the protecting position to the retracted position when the process cartridge is guided by said guide means and is moved along a movement path toward said mounting portion;

a wrong insertion preventing engagement portion configured and positioned to come into engagement with the shutter moving portion to open the shutter, on an upstream side of an engagement position in which the shutter moving portion and said shutter opening means are engaged with each other, in a mounting direction in which the process cartridge is mounted on said mounting portion when a process cartridge which does not match in function with a main body of said apparatus is inserted into the main body of said apparatus; and a main body shutter abutting portion configured and positioned to abut against the shutter moved toward the retracted position by the shutter moving portion being engaged with said wrong insertion preventing engagement portion, to restrict the insertion of the process cartridge.

2. An electrophotographic image forming apparatus according to claim 1, wherein said wrong insertion preventing engagement portion is a peripheral edge portion located above an opening portion, provided in the main body of said apparatus, through which opening portion the process cartridge is inserted into the main body of said apparatus.

3. An electrophotographic image forming apparatus according to claim 1 or 2, wherein said main body shutter abutting portion is a portion of an outer wall of an optical unit containing an optical system configured and positioned to apply information light to the electrophotographic photosensitive member, or/and a portion of a fixed stand of said optical unit.

4. An electrophotographic image forming apparatus for forming an image using an electrophotographic process, comprising:

a process cartridge including an electrophotographic photosensitive member, process means for acting on said electrophotographic photosensitive member, an openable and closable shutter having a photosensitive member protecting portion configured and positioned to protect said electrophotographic photosensitive member, and a shutter moving portion configured and positioned to open and close said shutter;

a main body of said image forming apparatus;

mounting guide means for mounting said process cartridge on said main body of said image forming apparatus;

shutter opening means for coming into engagement with said shutter moving portion to open said shutter at a predetermined engagement position on a movement path when said process cartridge is mounted on said main body of said image forming apparatus by said mounting guide means; and wrong insertion preventing guide means for changing, when a process cartridge which does not match in function with said main body of said image forming apparatus is inserted, the movement path on an upstream side of the predetermined engagement position on the movement path, and bringing said shutter moving portion into engagement with a peripheral region to open said shutter.

5. A process cartridge detachably mountable on a main body of an electrophotographic image forming apparatus, said process cartridge comprising:

an electrophotographic photosensitive member;

process means for acting on said electrophotographic photosensitive member;

a shutter having a photosensitive member protecting portion configured and positioned to protect said electrophotographic photosensitive member, and movable between a protecting position for protecting said electrophotographic photosensitive member and a retracted position retracted from the protecting position to expose said electrophotographic photosensitive member;

a shutter moving portion configured and positioned to come into engagement with shutter opening means provided in the main body of the apparatus to move said shutter from the protecting position to the retracted position when said process cartridge is mounted on the main body of the apparatus, and coming into engagement with a wrong insertion preventing engagement portion provided in the main body of the apparatus to move said shutter from the protecting position to the retracted position, on an upstream side of an engagement position in which said shutter moving portion and the shutter opening means are engaged with each other, in a mounting direction in which said process cartridge is mounted on the main body of the apparatus when said process cartridge is inserted into the main body of an apparatus which does not match in function with said process cartridge; and a cartridge shutter abutting portion provided on said shutter and configured and positioned to abut against a main body shutter abutting portion provided in the main body of the apparatus to restrict the insertion of said process cartridge into the main body of the apparatus when said shutter is moved toward the retracted position by said shutter moving portion being engaged with the wrong insertion preventing engagement portion.

6. A process cartridge according to claim 5, wherein said shutter moving portion is a cam portion configured and positioned to engage the shutter opening means of the main body of the apparatus.

7. A process cartridge according to claim 5 or 6, wherein said shutter moving portion is configured and positioned to engage an interfering device disposed in an opening portion of the main body of the image forming apparatus which does not match in function with said process cartridge.

8. A process cartridge according to claim 5 or 6, wherein said shutter moving portion is configured and positioned to interfere with a peripheral edge portion of an opening portion of the main body of the image forming apparatus which does not match in function with said process cartridge.

9. A process cartridge to be mounted on an electrophotographic image forming apparatus, said process cartridge comprising:

an electrophotographic photosensitive member;

process means for acting on said electrophotographic photosensitive member;

an openable and closable shutter provided with a photosensitive member protecting portion and configured and positioned to protect said electrophotographic photosensitive member;

a shutter moving portion configured and positioned to come into engagement with shutter opening means disposed in a predetermined engagement position on a movement path when said process cartridge is mounted on a main body of the image forming apparatus to open said shutter; and a wrong insertion preventing guide portion configured and positioned to change the movement path of said process cartridge to make said process cartridge interfere with a peripheral region to open said shutter when said process cartridge is inserted into the main body of an image forming apparatus which does not match in function with said process cartridge.

10. An electrophotographic image forming apparatus according to claim 1 or 4, wherein said process means includes at least one of charging means, cleaning means, and developing means.

11. A process cartridge according to claim 5 or 9, wherein said process means includes at least one of charging means, cleaning means, and developing means.

12. A process cartridge detachably mountable on a main body of an electrophotographic image forming apparatus, said process cartridge comprising:

an electrophotographic photosensitive member;

a charging roller configured and positioned to charge said electrophotographic photosensitive member;

a developing roller configured and positioned to develop an electrostatic latent image formed on said electrophotographic photosensitive member;

a shutter having a photosensitive member protecting portion for protecting said electrophotographic photosensitive member, and movable between a protecting position for protecting said electrophotographic photosensitive member and a retracted position retracted from the protecting position to expose said electrophotographic photosensitive member;

a shutter moving portion configured and positioned to come into engagement with shutter opening means provided in the main body of the apparatus to move said shutter from the protecting position to the retracted position when said process cartridge is mounted on the main body of the apparatus, and coming into engagement with a wrong insertion preventing engagement portion provided in the main body of the apparatus to move said shutter from the protecting position to the retracted position, on an upstream side of an engagement position in which said shutter moving portion and the shutter opening means are engaged with each other, in a mounting direction in which said process cartridge is mounted on the main body of the apparatus when said process cartridge is inserted into the main body of an apparatus which does not match in function with said process cartridge; and a cartridge shutter abutting portion provided on said shutter and configured and positioned to abut against a main body shutter abutting portion provided in the main body of the apparatus to restrict the insertion of said process cartridge into the main body of the apparatus when said shutter is moved toward the retracted position by said shutter moving portion being engaged with the wrong insertion preventing engagement portion.

13. An electrophotographic image forming apparatus for forming an image on a recording medium, comprising:

a cartridge mounting portion configured and positioned to detachably mount thereon a process cartridge, the process cartridge including: an electrophotographic photosensitive member; a charging roller configured and positioned to charge the electrophotographic photosensitive member; a developing roller configured and positioned to develop an electrostatic latent image formed on the electrophotographic photosensitive member; a shutter having a photosensitive member protecting portion configured and positioned to protect said electrophotographic photosensitive member, and movable between a protecting position for protecting the electrophotographic photosensitive member and a retracted position retracted from the protecting position to expose the electrophotographic photosensitive member; and a shutter moving portion configured and positioned to move the shutter from the protecting position to the retracted position;

guide means for guiding said process cartridge when said process cartridge is to be mounted on said mounting portion;

shutter opening means for coming into engagement with the shutter moving portion to open the shutter from the protecting position to the retracted position when said process cartridge is guided by said guide means and is moved along a movement path toward said mounting portion;

a wrong insertion preventing engagement portion configured and positioned to come into engagement with the shutter moving portion to open the shutter, on an upstream side of an engagement position in which the shutter moving portion and said shutter opening means are engaged with each other, in a mounting direction in which said process cartridge is mounted on said mounting portion when a process cartridge which does not match in function with a main body of said apparatus is inserted into the main body of said apparatus; and a main body shutter abutting portion for abutting against the shutter moved toward the retracted position by the shutter moving portion being engaged with said wrong insertion preventing engagement portion, to restrict the insertion of said process cartridge.

14. A process cartridge detachably mountable on a main body of an electrophotographic image forming apparatus, said process cartridge comprising:

an electrophotographic photosensitive member;

a charging roller configured and positioned to charge said electrophotographic photosensitive member;

a developing roller configured and positioned to develop an electrostatic latent image formed on said electrophotographic photosensitive member;

a shutter having a photosensitive member protecting portion configured and positioned to protect said electrophotographic photosensitive member, and movable between a protecting position for protecting said electrophotographic photosensitive member and a retracted position retracted from the protecting position to expose said electrophotographic photosensitive member;

a shutter moving portion for coming into engagement with shutter opening means provided in the main body of the apparatus to move said shutter from the protecting position to the retracted position when said process cartridge is mounted on the main body of the apparatus, and coming into engagement with a wrong insertion preventing engagement portion provided in the main body of the apparatus to move said shutter from the protecting position to the retracted position, on an upstream side of an engagement position in which said shutter moving portion and the shutter opening means are engaged with each other, in a mounting direction in which said process cartridge is mounted on the main body of the apparatus when said process cartridge is inserted into the main body of an apparatus which does not match in function with said process cartridge, wherein said shutter moving portion is designed to be engaged with interfering means disposed in an opening portion of the main body of the apparatus which does not match in function with said process cartridge; and a cartridge shutter abutting portion provided on said shutter and configured and positioned to abut against a main body shutter abutting portion provided in the main body of the apparatus to restrict the insertion of said process cartridge into the main body of the apparatus when said shutter is moved toward the retracted position by said shutter moving portion being engaged with the wrong insertion preventing engagement portion.

15. An electrophotographic image forming apparatus for forming an image on a recording medium, comprising:

a cartridge mounting portion configured and positioned to detachably mount thereon a process cartridge, the process cartridge including: an electrophotographic photosensitive member; a charging roller configured and positioned to charge the electrophotographic photosensitive member; a developing roller configured and positioned to develop an electrostatic latent image formed on the electrophotographic photosensitive member; a shutter having a photosensitive member protecting portion configured and positioned to protect the electrophotographic photosensitive member, and movable between a protecting position for protecting the electrophotographic photosensitive member and a retracted position retracted from the protecting position to expose the electrophotographic photosensitive member; a shutter moving portion configured and positioned to come into engagement with shutter opening means provided in a main body of said apparatus to move the shutter from the protecting position to the retracted position when the process cartridge is mounted on the main body of said apparatus, and to come into engagement with a wrong insertion preventing engagement portion provided in the main body of said apparatus to move the shutter from the protecting position to the retracted position, on an upstream side of an engagement position in which the shutter moving portion and the shutter opening means are engaged with each other, in a mounting direction in which the process cartridge is mounted on the main body of said apparatus when the process cartridge is inserted into the main body of an apparatus which does not match in function with the process cartridge, wherein the shutter moving portion is designed to be engaged with shutter opening means disposed in an opening portion of the main body of said apparatus which does not match in function with the process cartridge; and a cartridge shutter abutting portion provided on the shutter and configured and positioned to abut against a main body shutter abutting portion provided in the main body of said apparatus to restrict the insertion of the process cartridge into the main body of said apparatus when the shutter is moved toward the retracted position by the shutter moving portion being engaged with the wrong insertion preventing engagement portion;

guide means for guiding the process cartridge when the process cartridge is to be mounted on said mounting portion;

said shutter opening means for coming into engagement with the shutter moving portion to open the shutter from the protecting position to the retracted position when the process cartridge is guided by said guide means and is moved along a movement path toward said mounting portion;

said wrong insertion preventing engagement portion configured and positioned to come into engagement with the shutter moving portion to open the shutter, on the upstream side of the engagement position in which the shutter moving portion and said shutter opening means are engaged with each other, in the mounting direction in which the process cartridge is mounted on said mounting portion when a process cartridge which does not match in function with the main body of said apparatus is inserted into the main body of said apparatus; and said main body shutter abutting portion configured and positioned to abut against the shutter moved toward the retracted position by the shutter moving portion being engaged with said wrong insertion preventing engagement portion, to restrict the insertion of the process cartridge.

* * * * *

UNITED STATES PATENT AND TRADEMARK OFFICE

CERTIFICATE OF CORRECTION

PATENT NO. : 6,661,977 B1
DATED : December 9, 2003
INVENTOR(S) : Takeshi Kubota

It is certified that error appears in the above-identified patent and that said Letters Patent is hereby corrected as shown below:

Title page,
Item [65], Prior Publication Data, insert
-- [65] Prior Publication Data
US 2003/0223772 A1 Dec. 4, 2003 --.

Column 1,
Line 59, "the" (2nd occurrence) should be deleted.

Column 4,
Line 57, "it" should be deleted.

Column 9,
Line 60, "shutter 50a" should read -- shutter 50a, --.
Line 61, "insertion" should read -- insertion, --.

Signed and Sealed this

Sixth Day of July, 2004

JON W. DUDAS
*Acting Director of the United States Patent and Trademark Office*